US005605785A

United States Patent [19]

Texter et al.

[11] Patent Number: 5,605,785

[45] Date of Patent: Feb. 25, 1997

[54] ANNEALING PROCESSES FOR NANOCRYSTALLIZATION OF AMORPHOUS DISPERSIONS

[75] Inventors: John Texter, Rochester; David A. Czekai, Honeoye Falls, both of N.Y.

[73] Assignee: Eastman Kodak Company, Rochester, N.Y.

[21] Appl. No.: 412,252

[22] Filed: Mar. 28, 1995

[51] Int. Cl.[6] ..... G03C 1/815; G03C 7/30

[52] U.S. Cl. ..... 430/546; 430/377; 430/512; 430/543; 430/955

[58] Field of Search ..... 430/546, 130, 430/464, 512, 377, 543, 955

[56] References Cited

U.S. PATENT DOCUMENTS

| | | | |
|---|---|---|---|
| 2,870,012 | 1/1959 | Godowsky et al. . | |
| 3,658,545 | 4/1972 | Iwama et al. . | |
| 3,881,020 | 4/1975 | Nakamura et al. . | |
| 4,410,624 | 10/1983 | Plaschnick et al. . | |
| 4,474,872 | 10/1984 | Onishi et al. . | |
| 4,672,218 | 1/1987 | Chrisman et al. . | |
| 4,904,668 | 2/1990 | Kondo et al. . | |
| 4,973,465 | 11/1990 | Baurain et al. . | |
| 5,008,179 | 4/1991 | Chari et al. . | |
| 5,089,380 | 2/1992 | Bagchi . | |
| 5,110,717 | 5/1992 | Czekai et al. | 430/546 |
| 5,192,651 | 3/1993 | Tsukahara et al. . | |
| 5,240,821 | 8/1993 | Texter et al. . | |
| 5,274,109 | 12/1993 | Texter . | |
| 5,360,695 | 11/1994 | Texter . | |
| 5,401,623 | 3/1995 | Texter | 430/546 |

FOREIGN PATENT DOCUMENTS

| | | |
|---|---|---|
| 0554190 | 8/1993 | European Pat. Off. . |
| 0554834 | 8/1993 | European Pat. Off. . |
| 0555923 | 8/1993 | European Pat. Off. . |
| 0590567 | 4/1994 | European Pat. Off. . |
| 4000844 | 1/1990 | Germany . |
| 1193349 | 5/1970 | United Kingdom . |
| 1218190 | 1/1971 | United Kingdom . |
| 1285254 | 8/1972 | United Kingdom . |
| 1501223 | 2/1978 | United Kingdom . |
| 1570362 | 7/1980 | United Kingdom . |
| WO90/01559 | 2/1990 | WIPO . |
| WO92/06411 | 9/1991 | WIPO . |

*Primary Examiner*—Thorl Chea
*Attorney, Agent, or Firm*—Paul A. Leipold

[57] ABSTRACT

A process for forming a nanocrystalline dispersion of a photographically useful compound in a continuous phase comprising the steps of:

providing a nanoamorphous dispersion of said photographically useful compound in said continuous phase, and annealing said nanoamorphous dispersion to transform the physical state of said chemical compound therein to a crystalline physical state and to thereby obtain a nanocrystalline dispersion is disclosed.

26 Claims, 13 Drawing Sheets

Fig. 9a
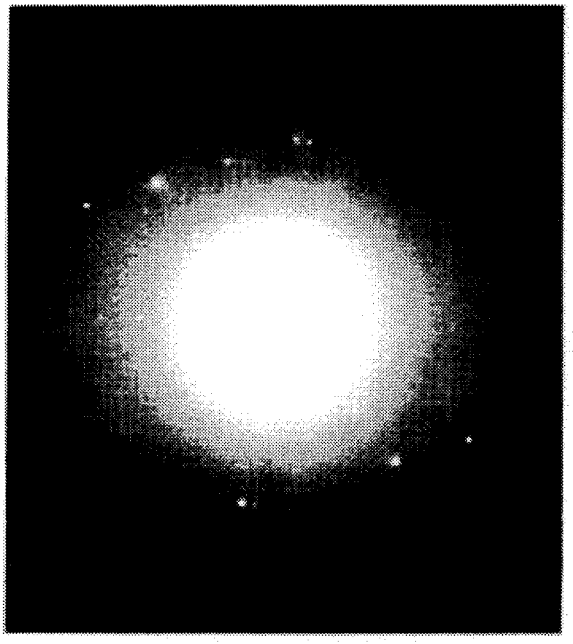
Fig. 9b
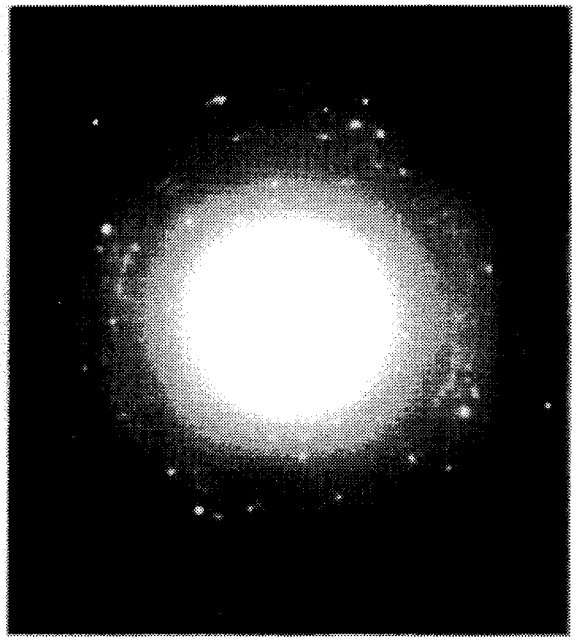
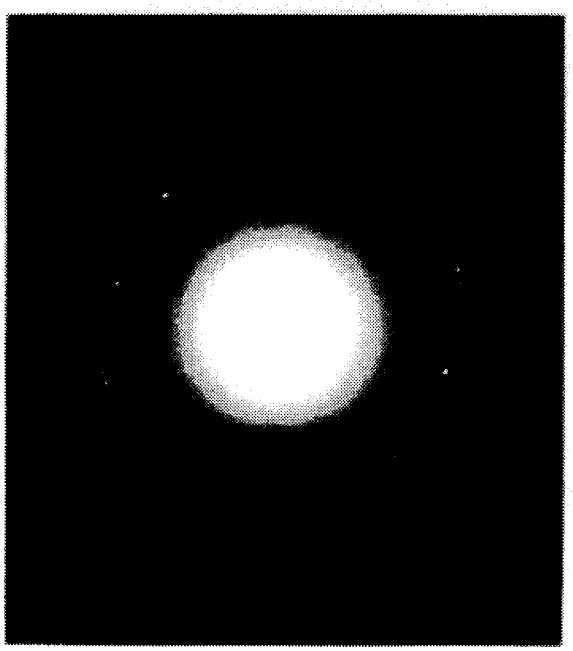
Fig. 9c
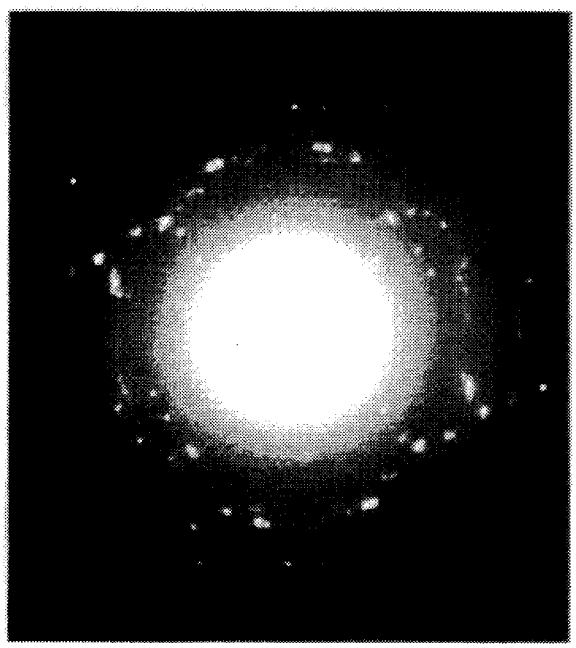
Fig. 9d

ANNEALING PROCESSES FOR NANOCRYSTALLIZATION OF AMORPHOUS DISPERSIONS

RELATED APPLICATION

This application is related to copending and commonly assigned U.S. application Ser. No. 08/247,180, Process for Forming Microcrystalline Coupler Dispersions, filed May 20, 1994, now U.S. Pat. No. 5,434,036.

FIELD OF THE INVENTION

This invention relates to nanocrystalline dispersions. This invention relates to the composition and physical state of compounds used in nanocrystalline dispersions. More particularly, this invention relates to nanocrystalline dispersions of photographically useful compounds. This invention relates to photographic systems and processes for forming images in light sensitive silver halide emulsion elements and to the nature of the dispersions of photographically active organic compounds used to form such images.

BACKGROUND OF THE INVENTION

The production of nanoamorphous dispersions of photographically useful compounds is described in U.S. Pat. No. 2,322,027 and in German Patent DD 299 608. Such dispersions are prepared by mechanical dispersion wherein the hydrophobic photographically useful compound is dissolved in a mixture of low-boiling and high-boiling solvents and this solution is then dispersed as an aqueous colloid solution by means of high speed stirring in the presence of surfactants.

Peterson and Weissberger, in U.S. Pat. No. 2,353,262, disclose that noncoupling compounds having a benzoylbenzene group, a sulfonamide group, or an alkyl group of at least 5 carbon atoms are useful in preventing crystallization of a coupler normally tending to crystallize and having a benzoylbenzene group and/or a benzoylacetamino group. Godowsky and Duane, in U.S. Pat. No. 2,870,012, disclose a solvent-shifting process for preparing microdispersions of color coupler compounds comprising at least one acid group (carboxyl or sulfonic acid).

Townsley and Trunley, in U.K. Pat. No. 1,193,349, disclose a solvent-shifting and pH-shifting process in the presence of a protective colloid for dispersing couplers as amorphous colloidal dispersions. Their process is applied to couplers that have no sulphonic acid or carboxylic acid solubilizing groups and that are soluble in a mixture of water-miscible organic solvent and aqueous alkali.

Kroha et al., in Patentschrift 138 831, disclose how photographically useful compounds rendered soluble as the result of substitution with sulfo groups, carboxyl groups, and the like, are generally present in a microcrystalline state when precipitated in aqueous gelatin solutions.

Sakamoto et al., in U.S. Pat. No. 3,700,454, disclose that conventionally prepared dispersions of certain couplers, prepared with a water-immiscible high boiling solvent, occasionally crystallize during the dispersing step or thereafter, with the result that the photographic properties of the light-sensitive material are greatly deteriorated. They also indicate, however, that control of such unwanted crystallization is difficult to achieve and that the coupler cannot sufficiently be prevented from crystallization.

Van Doorselaer et al. in U.S. Pat. No. 3,658,546, disclose that dispersions of water-insoluble photographic components with or without hydrophilic colloids form nanoamorphous dispersion that are stable enough to be stored. Nitttel and Reckziegel disclose in U.S. Pat. No. 3,689,271 that the emulsification of additives into a photographic element is stabilized by combining the additive with certain secondary carboxcylic acids before they are emulsified. These additive are indicated as having a pronounced tendency to prevent crystallization of couplers dispersed by emulsification.

Iwama et al., in U.S. Pat. No. 3,658,545, disclose that undesired crystallization occurs with certain classes of photographic couplers in combination with coupler solvents. Plaschnick et al., in U.S. Pat. No. 4,410,624, disclose that acid amides, phthalic acid esters, and phosphate esters have been found effective as solvents for couplers and that these solvents prevent crystallization manifestations. Deleterious effects of crystallization of photographically useful compounds are disclosed by Mäder et al. in Offenlegungsschrift DE 4,000,844 A1. Tsukahara and Kobayashi, in U.S. Pat. No. 5,192,651, disclose that couplers which have a p-cyanophenylureido group in the 2-position and a ballast group in the 5-position generally suffer from the disadvantage that they readily precipitate.

Nakamura et al., in U.S. Pat. No. 3,881,020, disclose a process of preparing aqueous suspensions of chlorampenicol palmitate to obtain fine and uniform alpha-type crystals having high bioactivity. Nakamura et al. teach that such fine and uniform crystals could never be obtained by any ordinary mechanical milling or conventional process, and they also teach methods of obtaining amorphous crystals.

Langen et al., in U.K. Pat. No. 1,570,362 and in Canadian Patent No. 1,105,761 disclose the use of solid particle milling methods such as sand milling, bead milling, dyno milling, and related media, ball, pebble, sand, bead, and roller milling methods for the production of solid particle dispersions of photographic additives such as couplers, UV-absorbers, UV stabilizers, white toners, stabilizers, and sensitizing dyes. These methods further include colloid milling, milling in an attriter, dispersing with ultrasonic energy, and high speed agitation (as disclosed by Onishi et al. in U.S. Pat. No. 4,474,872 and incorporated herein by reference). Details about these methods of milling may be found in Paint Flow and Pigment Dispersions by Temple C. Patton, published by John Wiley & Sons (New York; 1979), in Chapters 17–24 on pages 376–500.

Bagchi, in U.S. Pat. Nos. 4,970,139 and 5,089,380, discloses methods of preparing precipitated coupler dispersion with increased photographic activity. Said methods comprise steps to simultaneously precipitate hydrophobic couplers in the form of small particles and wherein said particles incorporate at their instant of formation water insoluble coupler solvents.

Young et al., in International Application WO 92/06411, disclose that couplers tend to be present as a supersaturated solution in an oily solvent and teach that additives may be added to delay or prevent crystallization. Mader et al., in Offenlegungsschrift DE 4,000,844 A1, disclose that certain non-diffusing yellow couplers are difficult to dissolve in solvents such as tricresyl phosphate and readily form crystalline precipitates to form coating defects and point defects. Such crystallization in dispersion making is known to result from crystals that are large enough to cause optical scattering problems, viscosity problems, and coating defects. Typically, such problem crystallites are known to be greater than 5–30 μm in largest dimension. It is known, on the other hand, that dispersions of nanocrystalline materials less than 1,000 nm in largest dimension do not scatter unduly, and generally are not problematic in coating melts or in liquid dispersion.

Chari et al., in U.S. Pat. No. 5,008,179, disclose the preparation of amorphous coupler dispersions by pH and solvent shifting and the mixing of said coupler dispersions with dispersions of permanent solvent immediately prior to preparing light sensitive coating melts. This process of combining permanent solvent with amorphous coupler dispersion minimizes certain difficulties arising from crystallization of said coupler during storage of the coupler dispersion. Chari et al. disclose the preparation of permanent solvent dispersions wherein the permanent solvent is loaded into a polymeric latex.

Kuhrt et al. in German Patent No. DD 299 608 disclose methods of preparing dispersions, and point out that nanoamorphous dispersions prepared with solvents are unstable and will coalesce on storage.

Czekai and Bishop, in U.S. Pat. No. 5,110,717, disclose the preparation of amorphous particles by first providing a microcrystalline dispersion of particles, raising the temperature of the dispersion above the melting point of the crystalline material, and cooling the dispersion to form amorphous particles.

Karino et al., in European Patent Application EP 0 554 834 A2, disclose methods for dispersing filter dyes for photographic applications. In particular, Karino et al. disclose heating processes for photographic filter dye materials and for nanocrystalline filter dye dispersions, and describe the effects of such heating on the resulting optical absorption of such dye materials. Karino et al. disclose that the molecular orientation of filter dyes in the form of solid particle dispersions may be modified by heat treatment, mechanical treatment, and high frequency treatment. These changes in molecular orientation have been correlated with changes in the visible absorption spectra of the corresponding dyes. Karino et al. disclose various thermal and chemical annealing processes for crystalline dye materials. Oppenheimer, in European Patent Application EP 0 555 923 A2, discloses that the formation of crystals in dispersions can interfere with the functioning of the dispersion, the coatability of the dispersion, and the optical properties of the dispersion, and that it is desirable to suppress crystal formation in photographic dispersions.

Texter, in European Patent Application EP 0 590 567 A1 and in U.S. Pat. No. 5,401,623, discloses the formation of microcrystalline coupler dispersions and the control of coupling reactivity by admixture with coupler solvents.

PROBLEM TO BE SOLVED BY THE INVENTION

The formation of nanocrystalline dispersions by milling and grinding of solid organic chemical compounds, while very effective in some applications, is ill suited for very large volume applications, where large amounts of material must be dispersed in a short amount of time. Furthermore, when the efficacy of dispersions of such solid organic compounds relies on these compounds being in a crystalline physical state and in reactive association with a low vapor pressure organic solvent, generally an additional mixing step must be employed in order to create this reactive association, subsequent to the formation of a dispersion of the crystalline organic compound.

These and other problems may be overcome by the practice of our invention.

SUMMARY OF THE INVENTION

An object of this invention is to more economically provide dispersions of chemical compounds. An object of this invention is to provide dispersions of chemical compounds that have improved stability against formation of large, deleterious crystals.

These and other objects of the invention are generally accomplished by providing a process for forming a nanocrystalline dispersion of a photographically useful compound in a continuous phase comprising the steps of:

providing a nanoamorphous dispersion of said photographically useful compound in said continuous phase, and annealing said nanoamorphous dispersion to transform the physical state of said chemical compound therein to a crystalline physical state and to thereby obtain a nanocrystalline dispersion.

BRIEF DESCRIPTION OF THE DRAWINGS

FIGS. 9*a*, 9*b*, 9*c*, and 9*d* Transmission electron micrographs of electron diffraction through thin cross sections of C1/undecanol dispersion particles.

ADVANTAGEOUS EFFECT OF THE INVENTION

Figure 1:
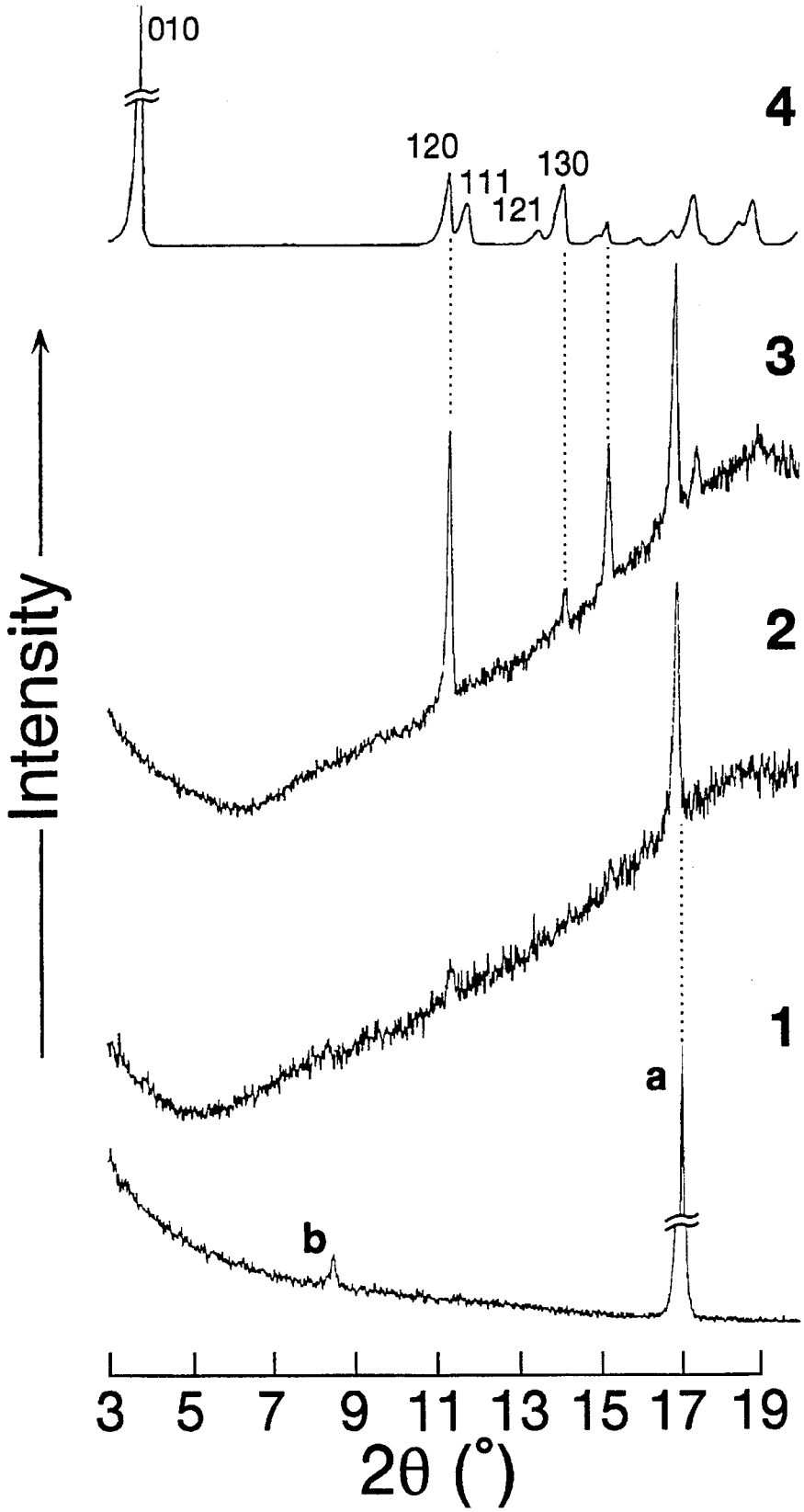
FIG. 1 Nanocrystallization of coupler C1 by thermal annealing.

Nanocrystalline dispersions prepared by the processes of the present invention may be prepared at a significantly greater volume per unit time than is possible with extant wet milling processes of size reduction of aqueous suspensions of crystalline materials. Heavy metal contamination generally introduced in extant wet milling processes of size reduction of aqueous suspensions of crystalline materials, emanating mainly from ceramic milling media attrition, is essentially eliminated in the processes of the present invention.

DETAILED DESCRIPTION OF THE INVENTION

The phrase physical state refers to whether a material is in the solid, liquid, or gaseous state, and if in the solid state, whether a solid material is amorphous or crystalline. The term crystalline as applied to chemical compounds of the dispersion particles in the present invention means that long range periodic order among the molecules of this chemical compound exists. Scattering and diffraction criteria and characteristics applicable to crystalline materials are explained and illustrated by H. P. Klug and L. E. Alexander in *X-ray Diffraction Procedures* (John Wiley & Sons, New York, 1974).

The term nanocrysalline dispersion means a particulate dispersion of a compound in a continuous phase, wherein the discontinuous particulate phase of this dispersion comprises this compound, wherein this compound is in a crystalline physical state, and wherein the number average size of the particles of this compound in this dispersion is less than 1000 nm. The term nanoamorphous dispersion means a dispersion of a compound in a continuous phase, wherein the discontinuous phase of this dispersion comprises this compound, and wherein this compound is in an amorphous physical state, and wherein the number average size of the particles of this compound in this dispersion is less than 1000 nm. The phrase compound crystalline mass fraction means the weight fraction of compound in a crystalline physical state relative to the total weight of compound in the dispersion. This total weight is equal to the sum of the weight of this compound in an amorphous physical state and the weight of this compound in a crystalline physical state.

The term solid particle dispersion means a dispersion of particles wherein the physical state of particulate material is solid rather than liquid or gaseous. This solid state may be an amorphous state or a crystalline state. The expression nanocrystalline particle means a particle that comprises a compound that is in a crystalline physical state. In preferred embodiments of the present invention, nanocrystalline dispersions of nanocrystalline particles have, on a number average basis, nanocrystalline particles smaller than 500 nm in average dimension and more preferably smaller than 200 nm in average dimension.

The term emulsification means formation of a dispersion of a particulate liquid phase A, the discontinuous phase, in a liquid phase B, the continuous phase, by mechanical agitation means. For example, if phase A is a water immiscible oil and phase B is water, and the oil were dispersed in the water by emulsification, an oil in water emulsion would result. Alternatively, if phase A is water and phase B is a water immiscible oil, and the water were dispersed in the oil by emulsification, a water in oil emulsion would result. The term emulsification subsumes the term homogenization.

In the processes of the present invention, nanoamorphous dispersions are transformed to nanocrystalline dispersions by annealing processes of the invention. These transformations are done under specific size constraints, so that the sizes of the nanocrystalline particles resulting are, on a number average basis, less than 1000 nm in average dimension. This size control is obtained by adjustment of annealing process variables such as time, temperature, chemical composition, and degree of mechanical agitation, as is required in particular compositions of the processes of the present invention.

The photographically useful compounds of the present invention, to be dispersed as nanoamorphous and nanocrystalline dispersions, include any photographically useful chemical substance that can exist at room temperature in a crystalline physical state. These compounds include dyes, filter dyes, sensitizing dyes, antihalation dyes, absorber dyes, UV dyes, stabilizers, UV stabilizers, redox dye-releasers, positive redox dye releasers, couplers, colorless couplers, competing couplers, dye-releasing couplers, dye precursors, development-inhibitor releasing couplers, development inhibitor anchimerically releasing couplers, photographically useful group releasing couplers, development inhibitors, bleach accelerators, bleach inhibitors, electron transfer agents, oxidized developer scavengers, developing agents, competing developing agents, dye-forming developing agents, developing agent precursors, silver halide developing agents, color developing agents, paraphenylenediamines, paraaminophenols, hydroquinones, blocked couplers, blocked developers, blocked filter dyes, blocked bleach accelerators, blocked development inhibitors, blocked development restrainers, blocked bleach accelerators, silver ion fixing agents, silver halide solvents, silver halide complexing agents, image toners, antifoggants, preprocessing image stabilizers, post-processing image stabilizers, hardeners, tanning agents, fogging agents, antifoggants, nucleators, nucleator accelerators, chemical sensitizers, surfactants, sulfur sensitizers, reduction sensitizers, noble metal sensitizers, thickeners, antistatic agents, brightening agents, discoloration inhibitors, development accelerators, blocked development accelerators, fixing agents, blocked fixing agents, and other addenda known to be useful in photographic materials. Specific examples of the developing agents and development accelerators include hydroquinones, catechols, aminophenols, p-pherlenediamines, pyrazolidones, and ascorbic acids, Examples of electron donors, foggants, and nucleating agents include α-hydroxyketones, α-sulfonamidoketones, hydrazines, hydrazines, tetrazolium salts, aldehydes, acetylenes, quaternary salts, and ylide compounds. Suitable silver halide solvents include thioethers, rhodanines, sodium thiosulfate, and methylenebissulfone. Examples of bleach accelerators and bleach-fix accelerators include aminoethanethiols, sulfoethanethiols, and aminoethanethiocarbamates. Fixing accelerators include sodium thiosulfate. Examples of suitable dyes include azo dyes, azomethine dyes, anthraquinone dyes, indophenol dyes, methine dyes, and indoaniline dyes. Among these useful materials of the present invention are blocked compounds and useful blocking chemistry described in U.S. Pat. Nos. 4,358,525, 4,554,243, 4,690,885, 4,734,353, 5,019,492, and 5,240,821 the disclosures of which are incorporated by reference herein in their entirety for all they disclose about useful photographic substances and the use of these substances in photographic elements. Numerous references to patent specifications and other publications describing these and other useful photographic substances are given in *Research Disclosure*, December 1978, Item No. 17643, published by Kenneth Mason Publications, Ltd. (The Old Harbormaster's, 8 North Street, Emsworth, Hampshire P010 7DD, England) and in T. H. James, *The Theory of The Photographic Process,* 4th Edition, Macmillan Publishing Co., Inc. (New York, 1977).

The couplers suitable for this invention may be any couplers that can be dispersed as solid particle nanocrystalline dispersions in an aqueous medium. Said couplers are substantially water insoluble at the pH and temperatures of dispersion preparation and use. Typical of such compounds are most photographic color couplers, including those which contain ionizing groups of moderate $pK_a$ such as carboxyl groups and sulfonamido groups. The term nanocrystalline means that long range order among the coupler molecules exists in the dispersion particles such that a sufficient number of such particles in a scattering-volume element will provide a conventional-looking powder diffraction pattern and d-spacings characteristic of small crystalline particles. Couplers are usually obtained in powdered crystalline form as a natural course of their synthesis and purification. In cases where couplers are obtained in an amorphous form, crystallization can be induced by methods well known in the art, such as thermal annealing, seed crystallization, crystallization from alternative solvents, etc.

Typical couplers of the present invention that form cyan dyes upon reaction with oxidized color developing agents are described in such representative patents as U.S. Pat. Nos. 2,313,586, 2,367,531, 2,369,929, 2,423,730, 2,474,293, 2,772,162, 2,801,171, 2,895,826, 3,002,836, 3,034,892, 3,041,236, 3,419,390, 3,476,563, 3,476,565, 3,772,002, 3,779,763, 3,996,252, 4,124,396, 4,248,962, 4,254,212, 4,282,312, 4,296,199, 4,296,200, 4,327,173, 4,333,999, 4,334,011, 4,427,767, 4,430,423, 4,443,536, 4,444,872, 4,451,559, 4,457,559, 4,500,635, 4,511,647, 4,518,687, 4,526,864, 4,557,999, 4,564,586, 4,565,777, 4,579,813, 4,613,564, 4,690,889, 4,775,616, and 4,874,689, in Canadian Patent No. 625,822, in European Patent Application No. 0 283 938 A1, and in European Patent No. 067 689B1the disclosures of which are incorporated by reference. Suitable couplers that form cyan dyes upon reaction with oxidized color developing agents are of the phenol type and the naphthol type. Typical couplers of the present invention that form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,311,476, 3,419,391, 3,519,429, 3,615,506, 3,725,067, 3,935,015, 3,936,015, 4,119,361, 4,120,723, 4,351,897, 4,385,111, 4,413,054, 4,443,536, 4,500,630, 4,522,916, 4,540,654, 4,581,326, 4,774,172, 4,853,319, and 4,874,689, Japanese Published Patent Application No. 60/170,854, European Patent Publication Nos. 0 170 164, 0 177 765, 0 240 852 A1, 0 283 938 A1, 0 284 239 A1, 0 284 240 A1, and 0 316 955 A3, and Research Disclosures 24220 (June 1984) and 24230 (June 1984), the disclosures of which are incorporated by reference. Suitable couplers that form magenta dyes include pyrazolone, pyrazolotriazole, and pyrazolobenzimidazole compounds. Typical couplers of the present invention that form yellow dyes upon reaction with oxidized color developing agent are described in such representative U.S. Pat. Nos. as 2,298,443, 2,875,057, 2,407,210, 2,875,057, 3,265,506, 3,384,657, 3,408,194, 3,415,652, 3,447,928, 3,542,840, 3,894,875, 3,933,501, 4,022,620, 4,046,575, 4,095,983, 4,133,958, 4,182,630, 4,203,768, 4,221,860, 4,326,024, 4,401,752, 4,443,536, 4,529,691, 4,587,205, 4,587,207 and 4,617,256, 4,622,287, 4,623,616, and in European Patent Applications 0 259 864 A2, 0 296 793 A1, 0 283 938 A1, and 0 316 955 A3, the disclosures of which are incorporated by reference. Suitable yellow dye image forming couplers are acylacetamides, such as benzoylacetanilides and pivaloylacetanilides. Photographically useful couplers of the present invention include couplers C1–C26, M1–M43, and Y1–Y26 disclosed in U.S. Pat. No. 5,401,623, the disclosure of which is incorporated herein in its entirety. Preferred photographically useful filter dyes of the present invention are disclosed in U.S. Pat. Nos. 4,833,246, 5,274,109, and 5,326,687, and in U.S. application Ser. No. 07/812,503 of Texter et al. filed Dec. 20, 1991, the disclosures of which are incorporated herein in by reference. Photographically useful blocked developers of the present invention are compounds 1–53 of U.S. Pat. No. 5,240,821, the disclosure of which is incorporated herein by reference.

Suitable processes for forming nanoamorphous dispersions of the processes of the present invention include any known process of emulsification that produces a disperse phase having amorphous particulates of number average diameter less than 1000 nm. These processes include solvent shifting, pH shifting, colloid milling, emulsification, homogenization, high speed stirring, sonication, and microemulsification. Emulsification and homogenization generally may be done by dissolving the compound of interest in a permanent solvent and/or in an auxiliary solvent to form a solution (phase A). This phase A is then emulsified with a separate phase B, typically composed of one or more solvents immiscible with phase A. Emulsification or homogenization is obtained by stirring these immiscible phases A and B under high shear and/or high pressure.

If sufficiently high temperatures are accessible, the use of solvents in preparing phase A may be omitted.

In preferred embodiments of the present invention when preparing a nanoamorphous dispersion by emulsification of an oil phase in an aqueous phase, use of an oil phase comprising the compound of the invention, wherein this oil phase is devoid of water-immiscible solvent, is excluded, since such oil phases are typically too viscous to result in acceptably small particle sizes.

Nanoamorphous dispersions may be prepared by solvent shifting as described by Godowsky and Duane in U.S. Pat. No. 2,870,012, the disclosure of which is incorporated herein by reference. Solvent shifting methods for preparing nanoamorphous dispersions are also disclosed by Townsley and Trunley in U.K. Patent No. 1,193,349. Chari discloses solvent shifting methods do prepare nanoamorphous dispersions in U.S. Pat. No. 5,008,179, the disclosure of which is incorporated herein by reference.

Solvent shifting is accomplished using two miscible solvents, C and D, for example. The object is to prepare a nanoamorphous dispersion of a compound in solvent C, where the solubility of the compound in solvent C is quite limited. A solvent D, miscible with solvent C, is used to prepare a solution of the compound. The compound is soluble in solvent D, but insoluble in solvent C. The solution of the compound in solvent D is then mixed or flooded with solvent C, and at an appropriate mixing ration of solvents D and C, the compound becomes insoluble and precipitates in particulate form. It is well known in the art that such precipitation, especially in a submicron size range, is into an amorphous physical state rather than a crystalline physical state. After precipitation into a particulate dispersion, solvent D is largely removed by any convenient means, such as evaporation, distillation, or washing. Stabilizers such as surfactants and polymers are advantageously added to one or both of solvents C and D to promote and stabilize small particle formation and to stabilize the nanoamorphous dispersions obtained. Pilot scale production of a nanoamorphous dispersion of a photographically useful dye compound by solvent shifting is described in detail by E. B. Gutoff and T. F. Swank in "Dispersion of Spherical Dye Particles by Continuous Precipitation" published in 1980 in *AIChE Symposium Series*, volume 76, on pages 43–51.

These same Townsley and Trunley and Chari references also disclose pH-shifting methods for preparing nanoamorphous dispersions. Bagchi, in U.S. Pat. Nos. 4,970,139 and 5,089,380 incorporated herein by reference, discloses solvent-shifting and pH-shifting methods of preparing nanoamorphous dispersions. Texter, in U.S. Pat. Nos. 5,274,109 and 5,326,687 incorporated herein by reference, discloses pH-shifting methods for preparing nanoamorphous dispersions. Other pH shifting methods for preparing nanoamorphous dispersions are disclosed by Texter et al. in U.S. application Ser. No. 7/812,503, *Microprecipitation Process for Dispersing Photographic Filter Dyes* filed Dec. 20, 1991, the disclosure of which is incorporated herein by reference. Nanoamorphous dispersions may be prepared from nanocrystalline dispersions by methods described by Czekai and Bishop in U.S. Pat. No. 5,110,717, the disclosure of which is incorporated herein by reference. Texter, in U.S. Pat. No. 5,234,807 incorporated herein for all it discloses about microemulsification, discloses microemulsification methods for preparing nanoamorphous dispersions.

The formation of nanoamorphous dispersions in aqueous media may be done using dispersing aids such as surfactants and surface active polymers. Such dispersing aids have been disclosed by Chari et al. in U.S. Pat. No. 5,008,179 (columns 13–14) and by Bagchi and Sargeant in U.S. Pat. No. 5,104,776 (see columns 7–13) and are incorporated herein by reference. Preferred dispersing aids include sodium dodecyl sulfate (D1), sodium dodecyl benzene sulfonate (D2), Aerosol-OT (Cyanamid; sodium bis(2-ethylhexyl)sulfosuccinate; D3), Aerosol-22 (Cyanamid; D4), Aerosol-MA (Cyanamid; D5), sodium bis(phenylethyl)sulfosuccinate (D6), sodium bis(2-ethylpentyl)sulfosuccinate (D7), Alkanol-XC (Du Pont; D8), Olin 10G (Dixie; D9), Polystep B-23 (Stepan; D10), Triton® TX-102 (Rohm & Haas; D11), Triton TX-200 (D12), Tricol LAL-23 (Emery; D13), Avanel S-150 (PPG; D14), Aerosol A-102 (Cyanamid; D15), and Aerosol A-103 (Cyanamid; D16). Such dispersing aids are typically added at level of 1%–200% of dispersed coupler (by weight), and are typically added at preferred levels of 3%–30% of dispersed coupler (by weight).

Permanent solvents suitable for use in the present invention may be any water immiscible organic solvent compatible with the crystalline compounds utilized. Such solvents have been disclosed, for example, by Bagchi in U.S. Pat. No. 4,970,139 and by Chari et al. in U.S. Pat. No. 5,008,179, the disclosures of which are incorporated herein by reference. Preferred permanent solvents include tri-cresyl phosphate (S1), di-n-butyl phthalate (S2), N,N-diethyl lauramide (S3), 2,4-di-t-amyl phenol (S4), 2,4-di-n-amyl phenol (S5), N-n-butyl acetanilide (S6), 1,4-cyclohexylene ethylhexanoate (S7), bis(2-ethylhexyl phthalate (S8), di-n-decyl phthalate (S9), bis(10,11-epoxyundecyl) phthalate (S10), tri-n-hexyl phosphate (S11), dimethyl phthalate (S12), 1-octanol (S13), 1-undecanol (S14), tri-cyclohexyl phosphate (S15), tri-isononyl phosphate (S16), tri-(2-ethylhexyl) phosphate (S17), p-dodecyl phenol (S18), N-n-amyl phthalimide (S19), bis(2-methoxyethyl) phthalate (S20), ethyl-N,N-di-n-butyl carbamate (S21), diethyl phthalate (S22), n-butyl-2 -methoxybenzoate (S23), bis(2-n-butoxyethyl) phthalate (S24), diethyl benzylmalonate (S25), guaiacol acetate (S26), tri-m-cresyl phosphate (S26), ethyl phenylacetate (S27), phorone (S28), di-n-butyl sebacate (S29), di-n-octyl phthalate (S30), cresyl diphenyl phosphate (S31), butyl cyclohexyl phthalate (S32), tetrahydrofurfuryl adipate (S33), guaiacol n-caproate (S34), bis(tetrahydrofurfuryl)phthalate (S35), N,N,N',N'-tetraethyl phthalimide (S36), N-n-amyl succinimide (S37), and triethyl citrate (S38).

Any known annealing process for transforming a material from an amorphous physical state into a crystalline physical state may be used as an annealing process in the processes of the present invention. These annealing processes include thermal annealing, chemical annealing, and mechanical annealing.

Chemical annealing processes of the present invention include annealing with slightly water-miscible organic solvents. Slightly water-miscible organic solvents are defined as organic solvents that are not completely water miscible. Examples of such slightly water-miscible organic solvents of the chemical annealing processes of the present invention include 2-(2-butoxyethoxy)ethyl acetate, 2-ethoxyethyl acetate, diethyl carbitol, 2-methyl-2-pentanol, methyl acetate, ethyl acetate, isobutyl acetate, 2-benzyloxyethanol, cyclohexanone, 2-(2-ethoxyethoxy)ethyl acetate, methyl isobutyl ketone, triethyl phosphate, 2-methyltetrahydrofuran, dichloromethane, 1,1,2-dichloroethane and 1,2-dichloropropane. Chemical annealing processes of the present invention using slightly water-miscible organic solvents include processes for removing these slightly water-miscible organic solvents during or after transformation of the dispersions of the present invention from nanoamorphous to nanocrystalline. Generally more than 90% of such slightly water-miscible organic solvent introduced is removed. More than 99% of such slightly water-miscible organic solvent introduced is preferably removed, so that transformation of physical state is made a more definite and robust process, less sensitive to long-term storage effects. This removal of slightly water-miscible organic solvent may be done by any known means, including evaporation, distillation, and washing means. This removal of slightly water-miscible organic solvent is preferably done by evaporation means or washing means.

Chemical annealing processes of the present invention also suitably include heating nanoamorphous dispersions of the present invention in the presence of polymeric materials, such as gelatin, carboxymethyl cellulose, polyacrylamides, poly(alkylene oxides), and other polymers.

Suitable chemical annealing processes of the present invention include mixing the nanoamorphous dispersions of the present invention with chemical agents such as acids, bases, complexing agents, and the like. Suitable examples of acids include weak carboxcylic acids such as acetic acid, butyric acid, and benzoic acid. Useful examples of acids include the secondary carboxcylic acids disclosed in U.S. Pat. No. 3,689,271 and incorporated herein by reference. Other suitable acids include mineral acids such as sulfuric acid, hydrochloric acid, phosphoric acid, etc. Suitable bases include alkali metal hydroxides, transition metal hydroxides, and various amines and nitrogen containing heterocyclic compounds. Suitable complexing agents include multidentate ligands, cyclic ethers, cyclic thioethers, transition metals, etc.

Preferred chemical annealing processes for aqueous based nanoamorphous dispersions of the present invention are done using diafiltration and ultrafiltration washing methods. The nanoamorphous dispersion of the present invention is placed in a filtration reactor, and then this reactor is operated at essentially constant volume with a inlet flow of annealing aqueous solution. This annealing aqueous solution may be water or a solution of a useful annealing agent in water. Preferred annealing agents are simple acids and bases, such as mineral acids and alkali hydroxides, to provide a pH shift during annealing. A suitable membrane filter is employed so that only molecules of sufficiently small molecular weight will be filtered out of the reactor with the effluent. After a suitable annealing period, the annealing solution may be changed to water or to some other composition in order to make any adjustments to pH or other composition desired in the continuous phase.

The thermal, chemical, and mechanical annealing processes of the present invention are preferably done at a temperature above the glass transition temperature of the chemical compound in the disperse phase of the nanoamorphous dispersions of the processes of the present invention. Improved kinetics of transformation from nanoamorphous to nanocrystalline are thereby obtained.

Mechanical annealing may be done by subjecting the nanoamorphous dispersion to a centrifugal field using sample or preparative scale centrifuges or centrifugal pumps. Mechanical annealing may also be done by using high speed stirring, as described for example by Onishi et al. in U.S. Pat. No. 4,474,872, the disclosure of which is incorporated herein by reference. Mechanical annealing may also be done by subjecting the nanoamorphous dispersion to an ultrasonic field in the frequency range 5 kHz to 8 MHz. Suitable ultrasonic reactors for doing annealing of dispersions are described by T. J. Mason and J. P. Lorimer in *Sonichemistry: Theory, Applications and Uses of Ultrasound in Chemistry*, Halstead Press, Chichester, 1988, Chapter 7, Ultrasonic equipment and chemical reactor design, pages 209–228.

In preferred embodiments of the process of the present invention the number average diameter of the chemical compound particulates transformed to a crystalline physical state is in the range of 10 to 500 nm so as to decrease the amount of visible light scattering emanating from these particulates. This range is more preferably 10 to 200 nm so as to minimize the amount of visible light scattering emanating from these particulates.

In certain preferred embodiments of the process of the present invention the compound crystalline mass fraction of the photographically useful compound in the nanocrystalline dispersion of the present invention is in the range of 10–97% so as to provide a balance between the stability properties of the crystalline mass fraction and the physical and chemical activity of the amorphous mass fraction. This range is more preferably in the range of 40–97% and most preferably in the range of 80–97% in order to further limit the amorphous mass fraction available to form untoward crystals. In other preferred embodiments of the process of the present invention the compound crystalline mass fraction of the photographically useful compound in the nanocrystalline dispersion of the present invention is in the range of 95–100% so as to dramatically limit any untoward influence of an amorphous mass fraction.

In the following discussion of suitable materials for use in the emulsions and elements according to the invention, reference will be made to *Research Disclosure*, December 1989, Item 308119, published by Kenneth Mason Publications Ltd., Emsworth, Hampshire P010 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-workng or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention are described in Research Disclosure Section IX and the publications cited therein. The radiation-sensitive materials described above can be sensitized to a particular wavelength range of radiation, such as the red, blue, or green portions of the visible spectrum or to other wavelength ranges, such as ultraviolet infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan colorforming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum to form a latent image as described in Research Disclosure Section XVIII, and then processed to form a visible dye image as described in Research Disclosure Section XIX. Processing can be any type of known photographic processing, although it is preferably carried out at pH 9 to 14.

The nanocrystalline dispersions of photographically useful compounds of the present invention may be incorporated into any suitable layer of photographic elements.

The nanocrystalline dispersions of the present invention may be used to form coating melts and coating solutions useful for forming light-sensitive photographic elements. Such elements may be black and white, monochrome, or chromogenic of one or more colors, with or without means of color separation. Useful photographic elements of the present invention are described, for example, in U.S. Pat. Nos. 4,378,424, 4,734,704, 4,791,095, 5,055,373, 5,168,029, 5,213,939, 5,216,438, 5,296,329, 5,298,373, and 5,304,542 and U.S. Statutory Invention Registration No. H953, the disclosures of which are incorporated herein by reference.

A negative image can be developed by using one or more of the aforementioned nucleophiles. A positive image can be developed by first developing with a nonchromogenic developer, then uniformly fogging the element, and then developing by a process employing one or more of the aforementioned nucleophiles. If the material does not contain a color forming coupler compound, dye images can be produced by incorporating a coupler in the developer solutions.

Development is followed by the conventional steps of bleaching, fixing, or bleach-fixing, to remove silver and silver halide, washing, and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The advantages of the present invention will become more apparent by reading the following examples. The scope of the present invention is by no means limited by these examples, however.

EXAMPLES

Examples 1–4

In this example, a preferred method of thermal annealing, after coating, is illustrated. Coupler C1 was dispersed as a nanoamorphous dispersion with the permanent solvent di-n-butyl phthalate, S2, in aqueous gelatin. C1 and S2 were combined at a weight ratio of

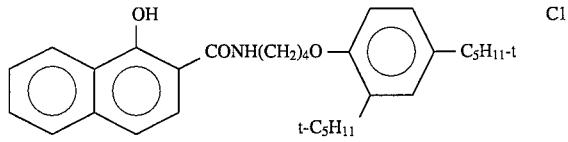

about 1:0.67 and dissolved in 2-(2-butoxyethoxy)ethyl acetate as auxiliary solvent. This solution was emulsified with an aqueous gelatin/Alkanol XC (Du Pont) solution using a colloid mill, chill set, noodled, and washed to remove the auxiliary solvent. The resulting nanoamorphous dispersion was about 6.4% by weight C1, about 6.9% gelatin, and the average particle diameter was about 200 nm. A sample of this dispersion was then melted and coated upon aluminum foil, at a wet coating thickness of about 380 μm. (15 mil). This coating was dried at room temperature.

A bare sample of the aluminum foil coating support was examined by x-ray diffraction (Example 1, curve 1), and a powdered crystalline sample (Example 4, curve 4) of coupler C1 was similarly examined by powder x-ray diffraction procedures. CuKα (1.54 Å) radiation was used with a graphite monochromator and a scintillation detector, using the front loading method. All of the data were evaluated using DIFFRAC-11 software. The reference, bare aluminum foil diffraction data are illustrated in FIG. 1 and are labeled there as curve 1. Two reflections of crystalline aluminum are evident at 2θ values of about 17° (peak b) and 8.7° (peak a). Curve 4 shows the diffraction pattern obtained for powdered and crystalline C1. The various reflections illustrated in curve 4 for crystalline C1 were derived from the single crystal x-ray structural study of C1, *Structure of N-[4-[2,4-bis(1,1-dimethylpropyl)-phenoxy]butyl]-1-hydroxy-2-naphthalene carboxamide*, published by H. R. Luss and J. Texter in *Acta Cryst.*, C47, 1491–1493 (1991). C1 packs according to the $Pca2_1$ space group, with unit cell parameters a=10.397 Å, b=23.018 Å, and c=11.667 Å. The 010, 120, 111, 121, and 130 hkl-assignments for prominent reflections are illustrated in curve 4. The extraordinary relative intensity illustrated in curve 4 for the 010 reflection obtains as a result of preferential orientation effects in the preparation of the powdered sample.

A sample of the coating (Example 2, curve 2) described above for the C1 nanoamorphous dispersion was also examined by x-ray diffraction. Curve 2 shows the diffraction pattern obtained for the coating of the C1 dispersion upon this aluminum foil support, and shows that the only significant reflections evident are those due to the underlying aluminum support. The rather broad and featureless background scattering is due mostly to the amorphous gelatin. The lack of perceptible diffraction peaks assignable to C1 crystalline reflections shows that the dispersion as coated in Example 2 is nanoamorphous. A sample of this C1 coating was then incubated for 5 days at 60° C. This incubated coating (Example 3) was then examined by x-ray diffraction, and the results are depicted as curve 3 in FIG. 1. Several prominent reflections assigned to crystalline C1 are evident, and their correspondence with the control material of curve 4 is denoted with dashed lines. A prominent reflection at about 17° from the underlying aluminum support is also evident in curve 3. The comparison of curves 2 and 3 shows that this preferred method of thermal annealing can transform a nanoamorphous dispersion into a nanocrystalline dispersion.

Examples 5–7

Thermal annealing after coating is illustrated here with coupler M1. Coupler M1 was dispersed as a nanoamorphous dispersion with the permanent solvent tricresyl phosphate, S1, in aqueous gelatin. M1 and S1 were combined at a weight ratio of 1:0.5 and

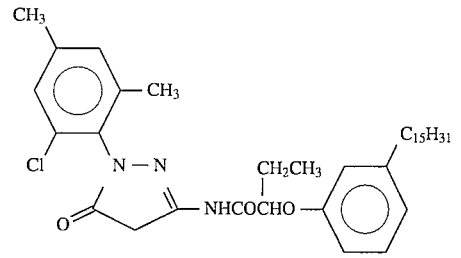

dissolved in 2-(2-butoxyethoxy) ethyl acetate as auxiliary solvent. This solution was emulsified with an aqueous gelatin/Alkanol XC (Du Pont) solution using a colloid mill, chill S1, in aqueous gelatin. M1 and S1 were combined at a weight ratio of 1:0.5 and dissolved in 2-(2-butoxyethoxy-)ethyl acetate as auxiliary solvent. This solution was emulsified with an aqueous gelatin/Alkanol XC (Du Pont) solution using a colloid mill, chill set, noodled, and washed to remove the auxiliary solvent. The resulting nanoamorphous dispersion had an average particle diameter in the range of 150–300 nm. A sample of this dispersion was then melted and coated on an aluminum foil support, at a wet coating thickness of about 380 μm. (15 mil). This coating was dried at room temperature.

Figure 2:
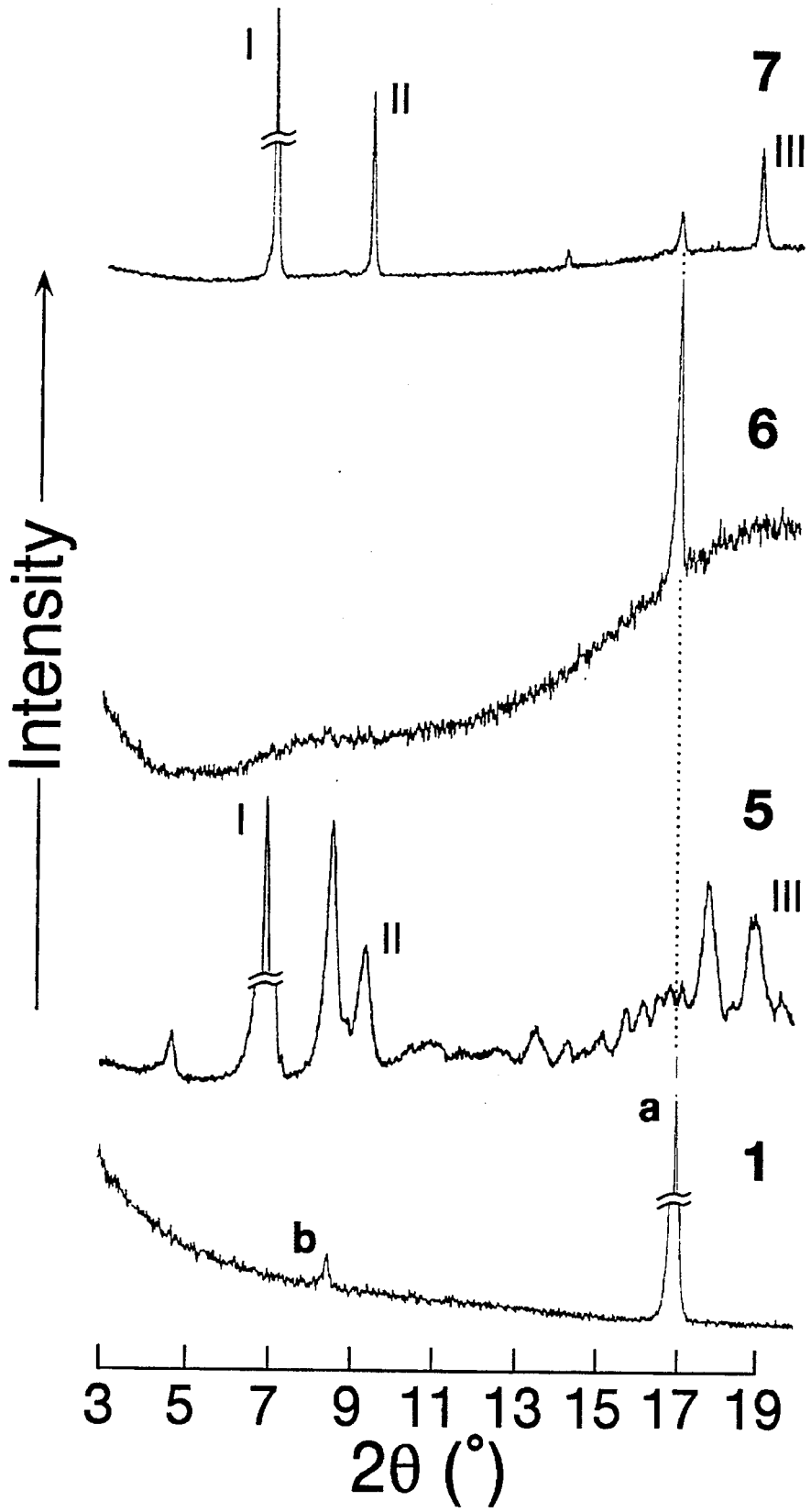
FIG. 2 Nanocrystallization of coupler M1 by thermal annealing.

X-ray diffraction analysis of a bare sample of the aluminum foil coating support (Example 1, curve 1) is illustrated in FIG. 2, and shows reflections a and b characteristic of crystalline aluminum. A powdered crystalline sample (Example 5, curve 5) of coupler M1 was similarly examined by the powder x-ray diffraction procedures described earlier for Example 4. A sample of the coating (Example 6, curve 6) described above for the M1 nanoamorphous dispersion was also examined, and curve 6 shows the diffraction pattern obtained for this coating of M1. The only reflection evident is that due to the a reflection of the underlying aluminum foil support. This shows that the M1 dispersion as coated in Example 6 is nanoamorphous. A sample of this M1 coating was then incubated for 5 days at 60° C. This incubated coating (Example 7) was then examined by x-ray diffraction, and the results are depicted as curve 7 in FIG. 2. Several prominent reflections, labeled I, II, and III on curve 7 correspond to the bulk crystalline powder reflections illustrated in curve 5. This correspondence shows that a nanocrystalline dispersion of M1 was produced in this example coating as a result of this thermal annealing of the nanoamorphous dispersion in the coating of Example 6 (curve 6).

Examples 8–10

Thermal annealing after coating is illustrated here with coupler C2. Coupler C2 was dispersed as a nanoamorphous dispersion with the permanent solvent S2 in aqueous gelatin.

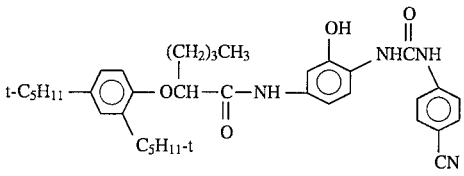

C2 and S2 were combined at a weight ratio of 1:1 and dissolved in 2-(2-butoxyethoxy)ethyl acetate as auxiliary solvent. This solution was emulsified with an aqueous gelatin/Alkanol XC (Du Pont) solution using a colloid mill, chill set, noodled, and washed to remove the auxiliary solvent. The resulting nanoamorphous dispersion had an average particle diameter in the range of 150–300 nm. A sample of this dispersion was then melted and coated on an aluminum foil support, at a wet coating thickness of about 380 μm. (15 mil). This coating (Example 8) was dried at room temperature.

Figure 3:
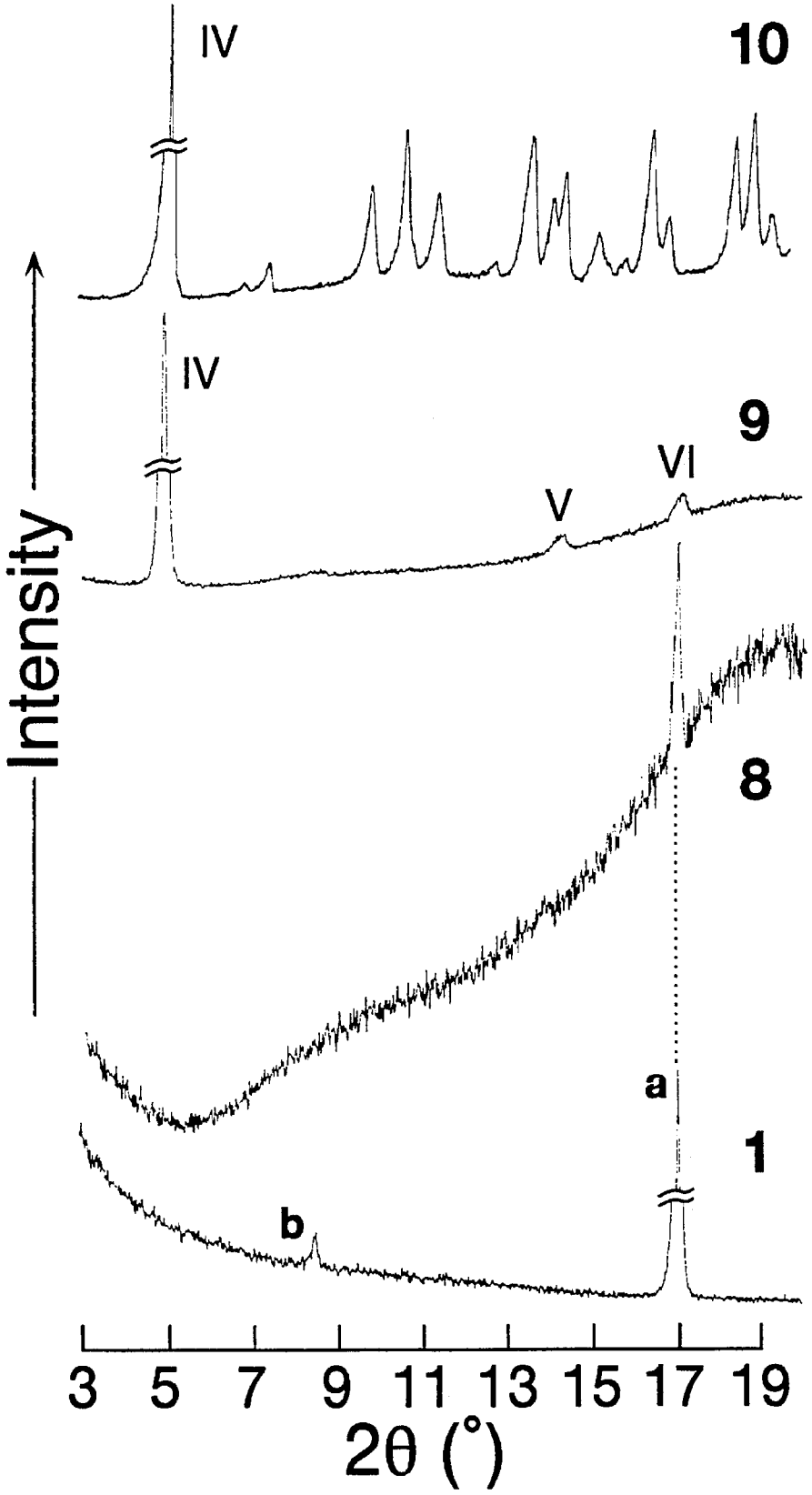
FIG. 3 Nanocrystallization of coupler C2 by thermal annealing.

X-ray diffraction analysis of a bare sample of the aluminum foil coating support (Example 1, curve 1) is illustrated in FIG. 3, and shows reflections a and b characteristic of crystalline aluminum. A powdered crystalline sample (Example 10, curve 10) of coupler C2 recrystallized from S2 was similarly examined by the powder x-ray diffraction procedures described earlier for Example 4. A sample of the coating (Example 8, curve 8) described above for the C2 nanoamorphous dispersions was also examined, and curve 8 shows the diffraction pattern obtained for this coating of C2. The only reflection evident is that due to the a reflection of the underlying aluminum foil support. This shows that the C2 dispersion as coated in Example 8 is nanoamorphous. A sample of this C2 coating was then incubated for 5 days at 60° C. This incubated coating (Example 9) was then examined by x-ray diffraction, and the results are depicted as curve 9 in FIG. 3. A prominent reflection, labeled IV on curve 9, correspond to the bulk crystalline powder reflection labeled IV on the control curve 9. Two smaller reflections, labeled V and VI on curve 9, are also evident. These reflections on curve 9 show that a nanocrystalline dispersion of C2 was produced in this example coating as a result of this thermal annealing of the nanoamorphous dispersion in the coating of Example 8 (curve 8).

Examples 11–13

Thermal annealing of bulk liquid dispersion is illustrated here with coupler C3. Coupler C3 was dispersed as a nanoamorphous dispersion with the permanent solvent S2 in aqueous gelatin. C3 and S2 were combined at a weight ratio of 1:0.5 and emulsified with an aqueous gelatin/D8 solution using homogenization. The resulting

Figure 4:
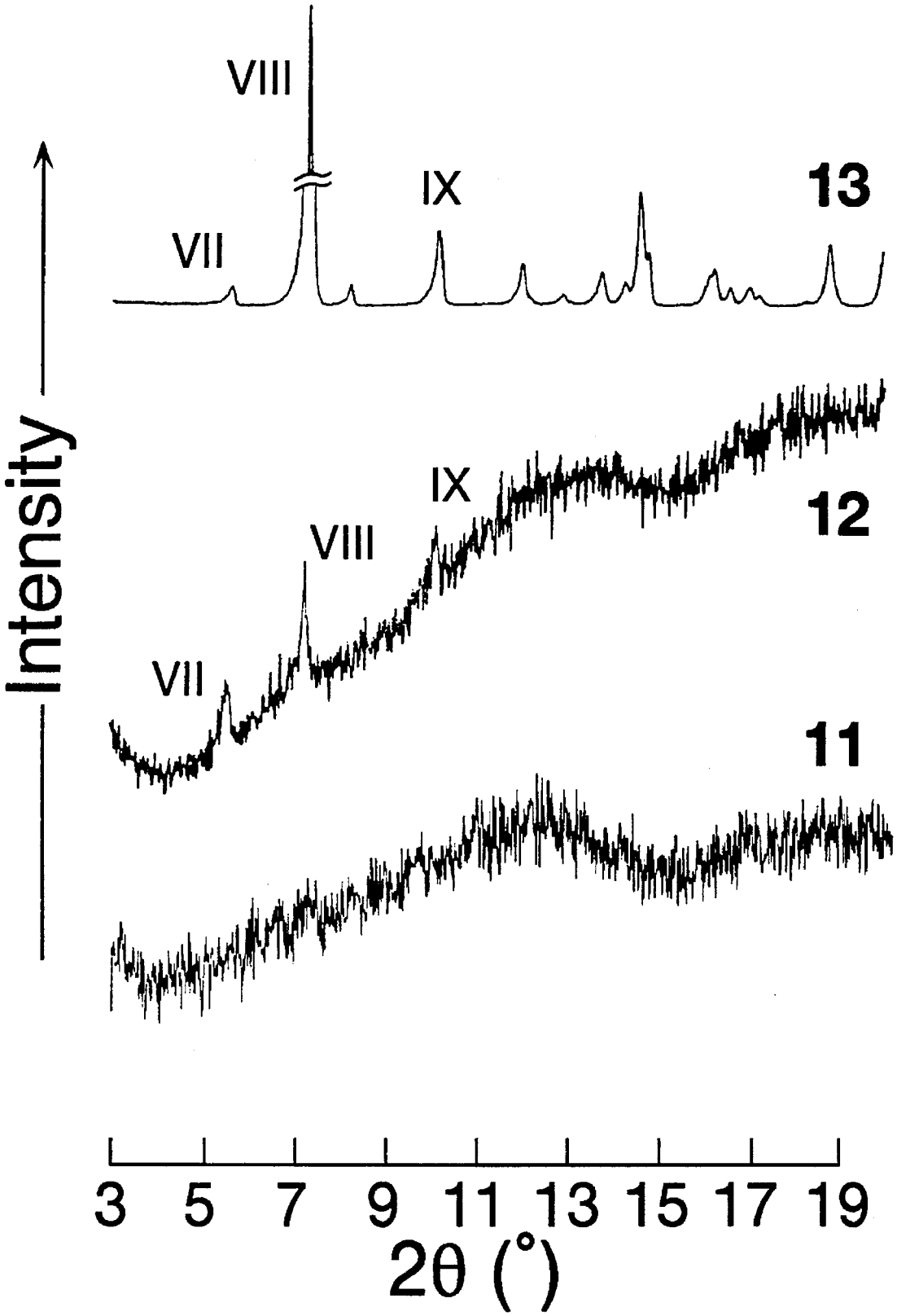
FIG. 4 Nanocrystallization of coupler C3 by thermal annealing.

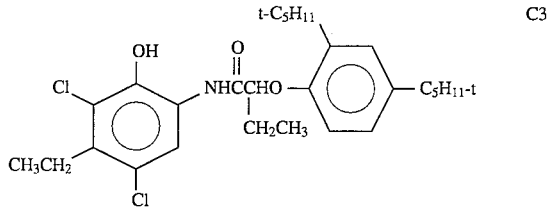

nanoamorphous dispersion (Example 11) had an average particle diameter in the range of 150–300 nm. A sample of this dispersion was briefly incubated with a proteolytic enzyme to digest some of the continuous phase gelatin, sedimented in a lab-top centrifuge, and then examined by x-ray diffraction analysis; the diffraction data are illustrated in curve 11 of FIG. 4, and shows only diffuse, amorphous scattering. A sample of this dispersion was then incubated for 21 h at 60° C., subjected to proteolytic digestion, centrifuged, and examined by x-ray diffraction. Results for this incubated sample (Example 12) are shown as curve 12 of FIG. 4. Several distinct reflections labeled VII, VIII, and IX in curve 12 correspond to similarly labeled reflections in the control sample (Example 13) of powdered coupler C3 illustrated as curve 13. The appearance of these reflections in curve 12 confirms the transformation of the nanoamorphous dispersions of curve 11 to a nanocrystalline dispersion.

Example 14

Figure 5:
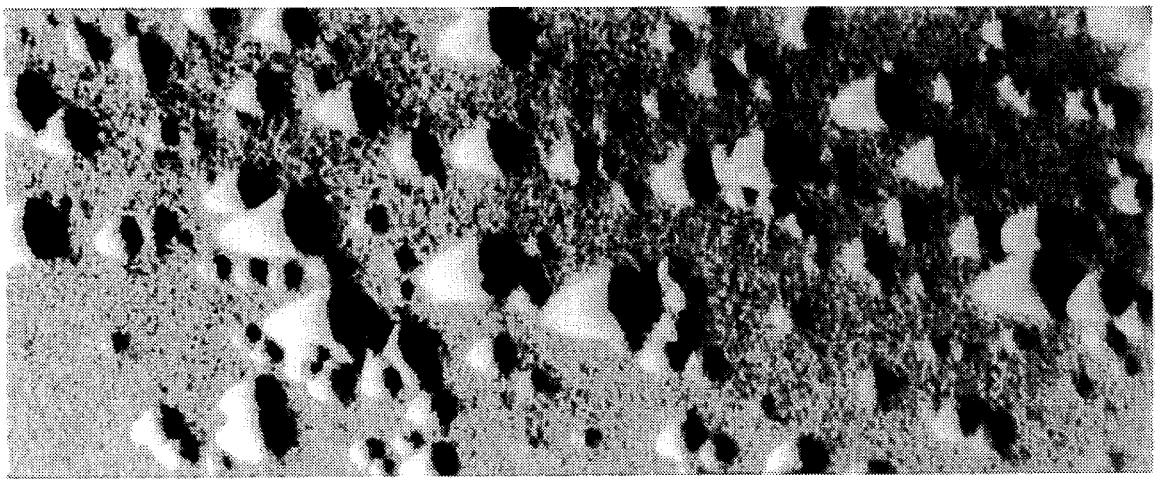
FIG. 5 Transmission electron micrograph of nanocrystalline C1/undecanol dispersion produced by chemical annealing.
Figure 6:
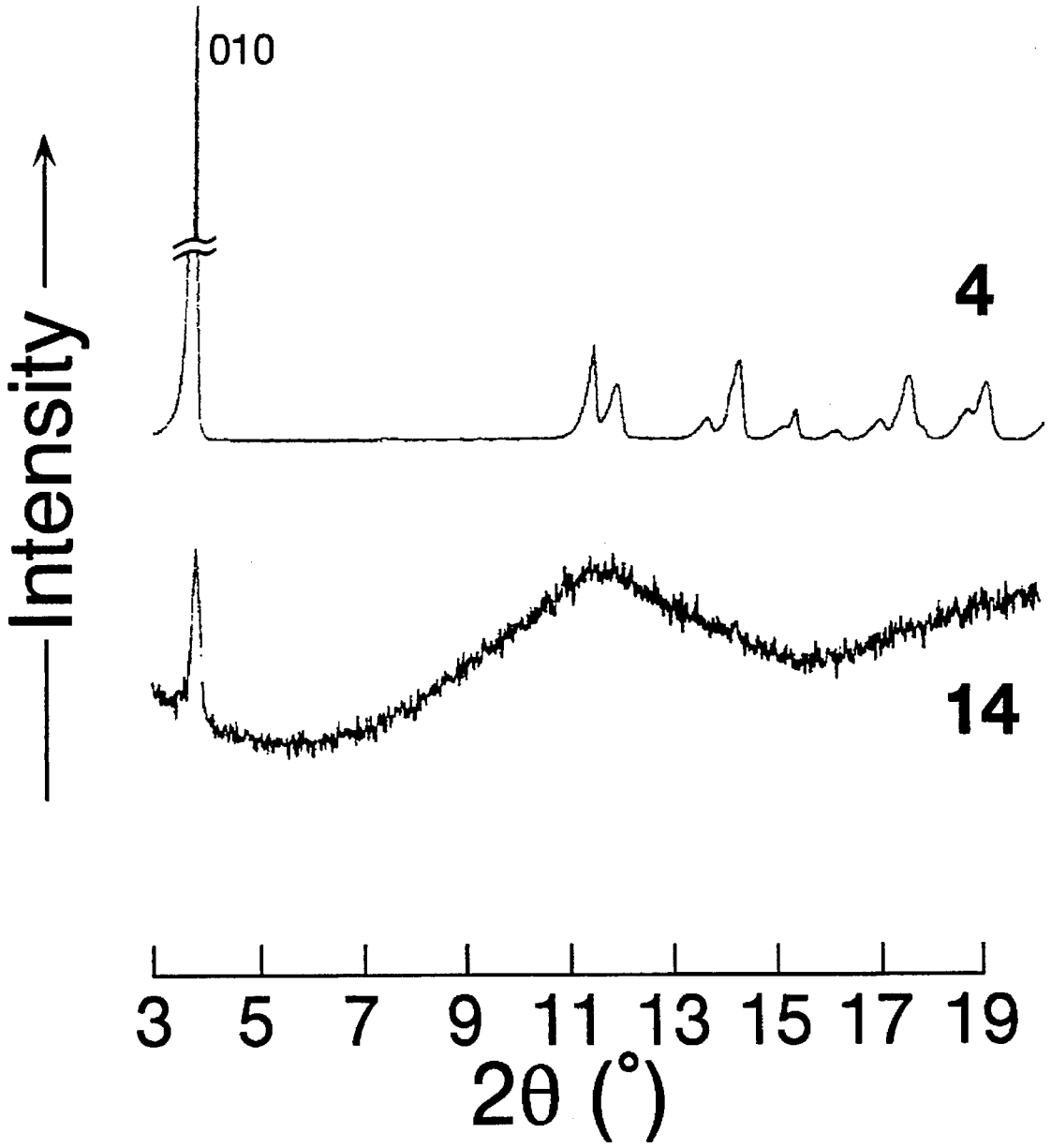
FIG. 6 Diffraction from nanocrystalline C1/undecanol dispersion produced by chemical annealing.

Chemical annealing of bulk liquid dispersion is illustrated here with coupler C1 in combination with undecanol (S14) as permanent solvent and ethyl acetate as auxiliary solvent. Coupler C1 was dispersed as a nanoamorphous dispersion at a 1:0.35 weight ratio with the permanent solvent S14. C1 (30 g) and S14 (9.5 g) were dissolved in 70.5 g of ethyl acetate. An aqueous solution comprising 280 g 12.5% (w/w) aqueous gelatin, 55 g 10% (w/w) aqueous D8, and 55 g water was prepared. This aqueous solution was then emulsified with the C1/S14 ethyl acetate solution using a colloid mill, chill set, and noodled. This noodled dispersion was then washed with water for 12 h to remove the slightly water-miscible ethyl solvent. This chemically annealed dispersion was examined by transmission electron microscopy after spotting, drying, and shadowing with Pt/Pd, and the resulting dispersion is illustrated in the micrograph of FIG. 5. A sample of this dispersion was also examined by x-ray diffraction, and is illustrated in FIG. 6 as curve 14, along with powder diffraction data of a control sample of crystalline C1 (curve 4). A prominent 010 reflection for C1 is strikingly evident in curve 14, showing that the chemically annealed dispersion has been transformed into a nanocrystalline dispersion.

Examples 15–17

Figure 7:
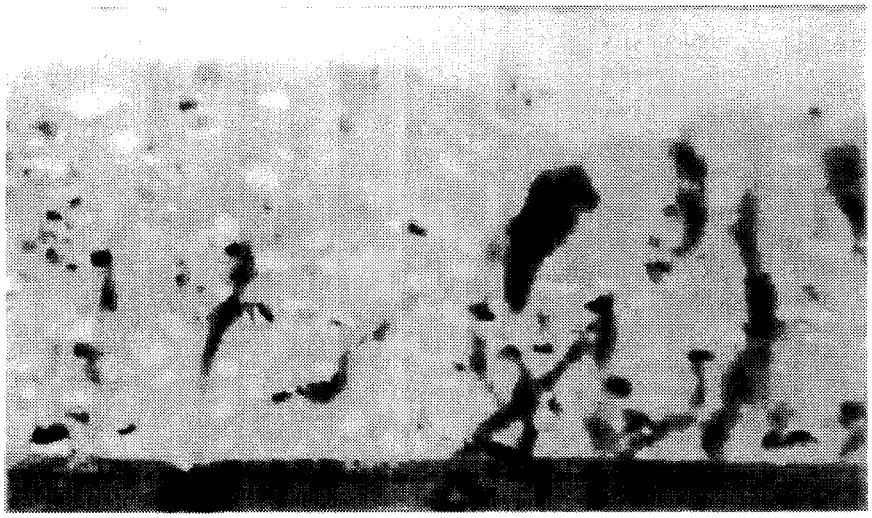
FIG. 7 Transmission electron micrograph of cross section of C1/undecanol dispersion coating.
Figure 8:
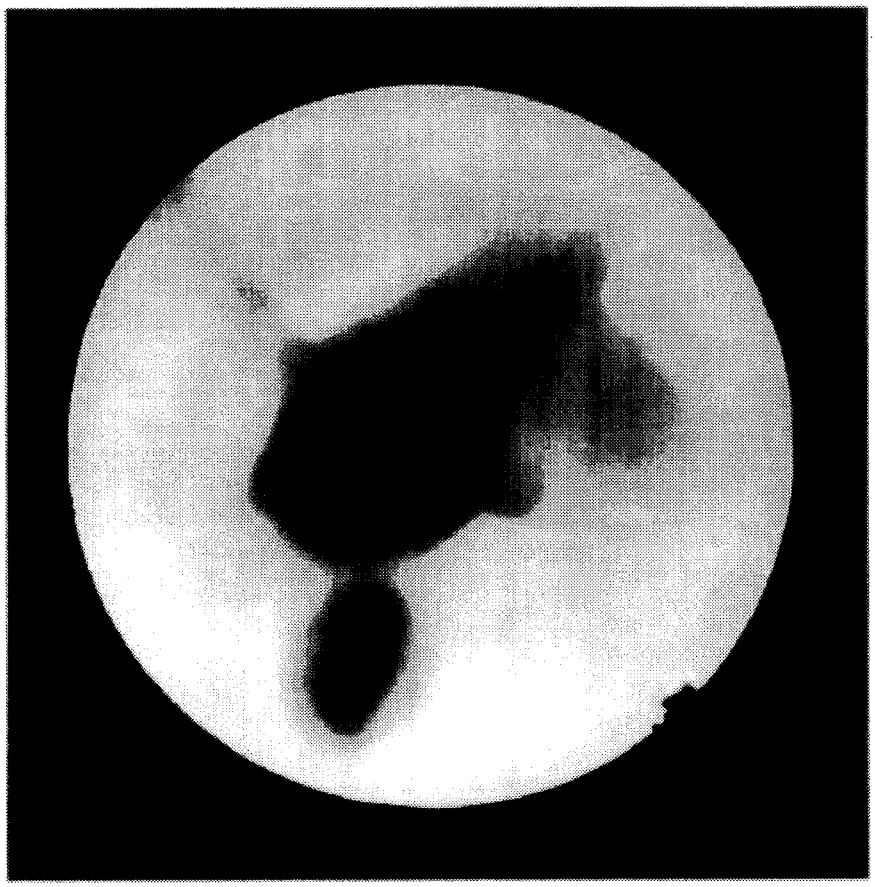
FIG. 8 Transmission electron micrograph of cross section of C1/undecanol dispersion particle.

Chemical annealing of bulk liquid dispersion is again illustrated here with coupler C1 in combination with undecanol (S14) as permanent solvent and ethyl acetate as auxiliary solvent, except that the dispersing aid D8 used in Example 14 was omitted so as to produce a larger average particle size in the dispersed particles. Coupler C1 was dispersed as a nanoamorphous dispersion at a 1:0.32 weight ratio with the permanent solvent S14. C1 (15 g) and S14 (4.75 g) were dissolved in 35.25 g ethyl acetate. An aqueous solution comprising 140 g 12.5% (w/w) aqueous gelatin and 55 g water was prepared. This aqueous solution was then emulsified with the C1/S14 ethyl acetate solution using a colloid mill, chill set, and noodled. This noodled dispersion was then washed with water for 12 h to remove the slightly water-miscible ethyl solvent. This chemically annealed dispersion (Example 15) had many particles with diameters on the order of 500 nm and was coated in a hardened gelatin layer upon a transparent film support base. A very thin cross-section (Example 16) of this coating is illustrated in the transmission electron micrograph of FIG. 7 at a magnification of about 3200×. The hardened gelatin/dispersion layer is pictured above the coating support base. This cross-section was about 100 nm thick. The many white spots are holes left by dispersion particles that were pulled out of the section during microtoming. The dark spots are cross-sections of particles that remained in the cross-section sample. No silver halide was coated in this specimen. One (Example 17) of these thin cross-sections of coated dispersion particle is illustrated at greater magnification (60000×) in the transmission electron micrograph of FIG. 8. The longest dimension of the particle section illustrated in FIG. 8 is approximately 500 nm. These kinds of cross-sections were used for electron micro-diffraction analysis. A series of electron micro-diffraction patterns obtained for four different particles in this coating is illustrated in FIGS. **9*a*, 9*b*, 9*c*, and 9*d*. The micro-diffraction patterns consist of spots arranged on Debye rings and suggest the presence of randomly oriented nanocrystallites of a grains size that is significant when compared to the size of the area samples (about 1.3 μm in diameter). The inelastic scatter around the incident beam is too great to resolve the low order reflections that correspond to interplanar spacings greater than about 6 Å. The spots which are resolved correspond to interplanar spacings less than 6 Å. These observations of crystalline electron micro-diffraction patterns in cross-sections of these dispersion particles shows that the physical state of these particles has been transformed from a liquid C1/S14** ethyl acetate solution to a nanocrystalline physical state. This transformation was expedited by the chemical annealing attendant the aqueous washing/extraction procedure for ethyl acetate removal.

Example 18 and 19

Figure 10:
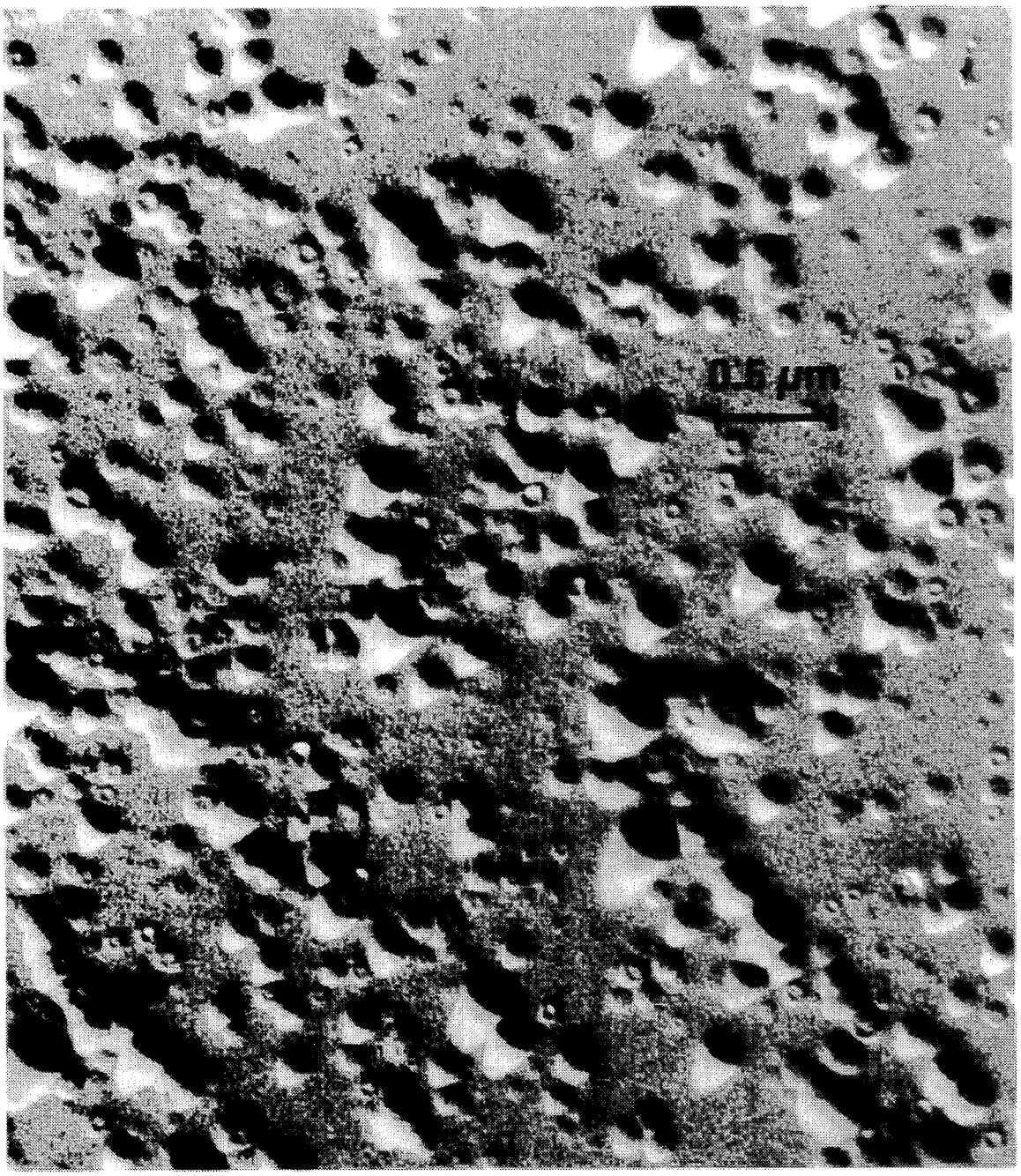
FIG. 10 Transmission electron micrograph of nanocrystalline C1/tricyclohexyl phosphate dispersion produced by chemical annealing.
Figure 11:
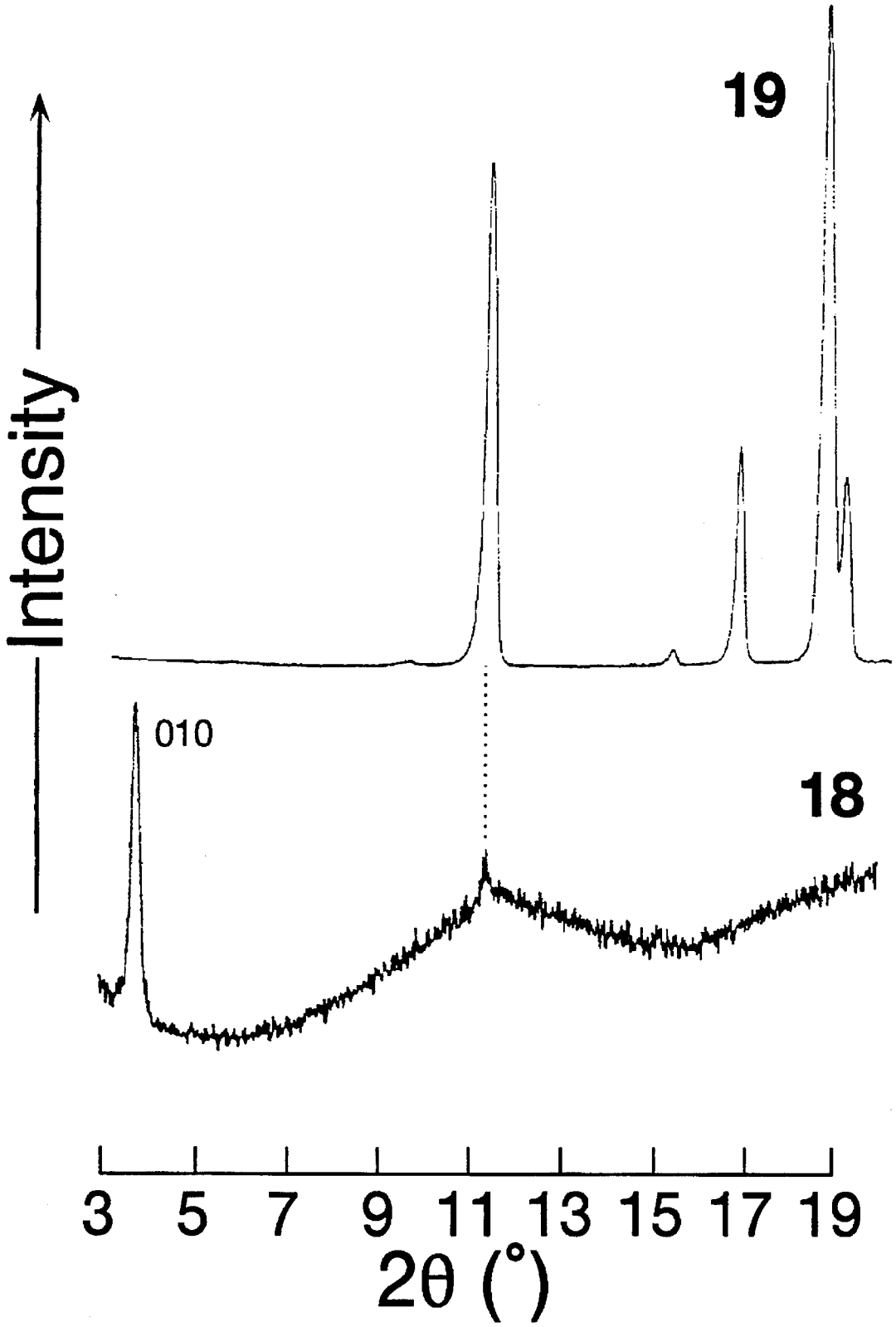
FIG. 11 Diffraction from nanocrystalline C1/tricyclohexyl phosphate dispersion produced by chemical annealing.

Chemical annealing of bulk liquid dispersion is illustrated here with coupler C1 in combination with tricyclohexyl phosphate (S15) as permanent solvent and ethyl acetate as auxiliary solvent. Coupler C1 was dispersed with the permanent solvent S15 as a nanoamorphous dispersion at a 1:0.63 weight ratio with the permanent solvent S15. C1 (30 g) and S15 (19 g) were dissolved in 61 g of ethyl acetate. An aqueous solution comprising 280 g 12.5% (w/w) aqueous gelatin, 55 g 10% (w/w) aqueous D8, and 55 g water was prepared. This aqueous solution was then emulsified with the C1/S15 ethyl acetate solution using a colloid mill, chill set, and noodled. This noodled dispersion was then washed with water for 12 h to remove the slightly water-miscible ethylacetate solvent. This chemically annealed dispersion (Example 18) was examined by transmission electron microscopy after spotting, drying, and shadowing with Pt/Pd, and the resulting dispersion is illustrated in the micrograph of FIG. 10. A sample of this dispersion was also examined by x-ray diffraction, and is illustrated in FIG. 11 as curve 18, along with powder diffraction data of a control sample (Example 19) of crystalline S15 (curve 19). A prominent 010 reflection for C1 is strikingly evident in curve 18. Also evident in curve 18 is a reflection corresponding to that of the crystalline permanent solvent S15. These reflections illustrated in curve 18 show that this chemically annealed dispersion has been transformed into a nanocrystalline dispersion.

Examples 20–22

Figure 12:
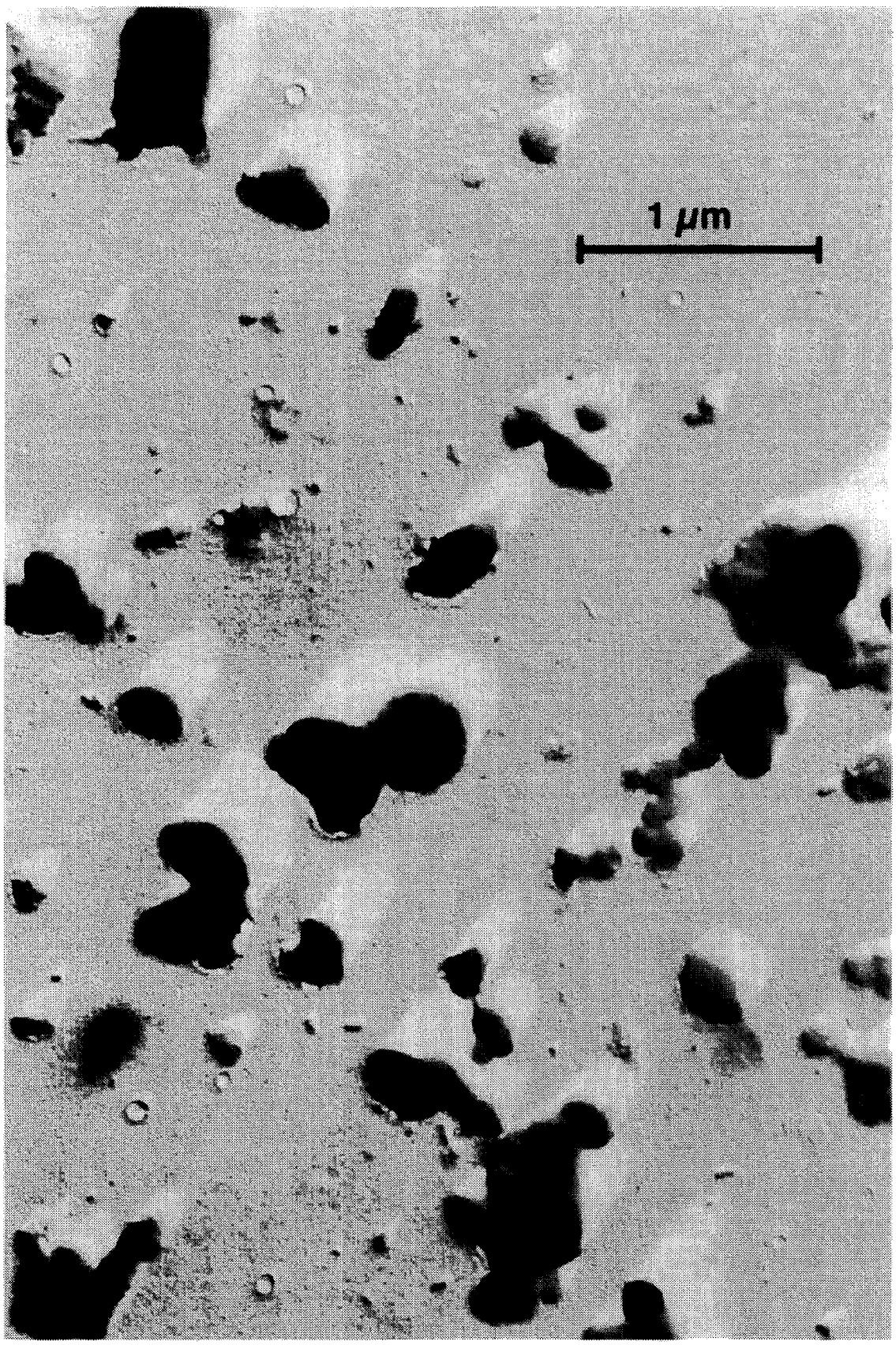
FIG. 12 Transmission electron micrograph of nanocrystalline dispersion of coupler C1

A nanocrystalline dispersion of coupler C1 was prepared by direct methods described in U.S. Pat. No. 5,401,623. A mixture comprising 5.0 g C1, 1.26 g Aerosol OT dispersant (D3), 50.0 g distilled water, 5.0 g of 12.5% (w/w) aqueous gelatin, and about 100 mL of zirconia milling beads were placed in a jar and milled on a roller mill for 3 days. After milling, 40.0 g of 12.5% (w/w) aqueous gelatin was added and milled briefly to achieve good mixing. The resulting dispersion was separated from the milling media by filtration and analyzed by HPLC for C1 concentration. This dispersion (Example 20) was found to be 5.4% C1 (w/w). A sample of this dispersion was analyzed by transmission electron microscopy. This sample was diluted with water, spotted on a grid, dried, and coated with a Pt/Pd mixture to provide contrast. A photomicrograph of this sample at a magnification of about 40000× is illustrated in FIG. 12. It is apparent the particles are somewhat tabular in morphology, which follows as a result of the layered sheet structure C1 adopts in the crystalline state [*Acta Cryst.*, C47, 1491–1493 (1991)]. The largest particles are on the order of 500 nm in equivalent circular diameter, and there are many particles in the 100–200 nm equivalent circular diameter range. The shadow angles indicate information on the thicknesses of these particles. Nominal thicknesses are on the order of about a third of the shadow lengths, and predominantly are in the 50–100 nm range.

Figure 13:
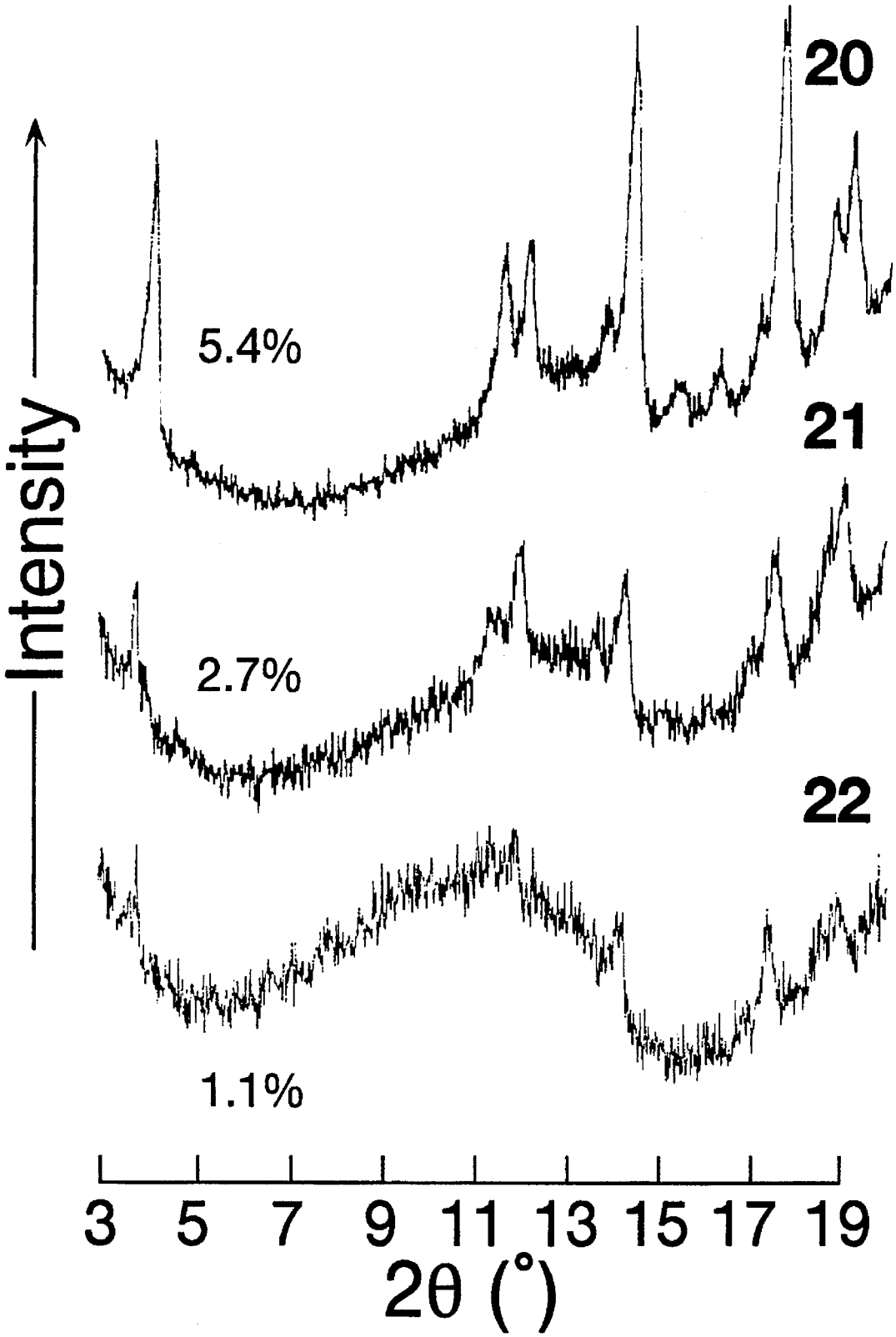
FIG. 13 Diffraction of nanocrystalline coupler C1 at various weight fractions in aqueous gelatin.

This nanocrystalline dispersion of C1 (Example 20) was used to prepare two diluted dispersions. Aqueous 12.5% (w/w) gelatin was used to prepare a 50% (w/w) dilution (Example 21) and a 20% dilution (Example 22), with resulting weight fractions of C1 of 2.7% and 1.1%, respectively. These dilutions were made using water and 12.5% (w/w) aqueous gelatin, keeping the gelatin constant at about 6% (w/w). These three nanocrystalline dispersions of C1 were then examined by x-ray diffraction, and the results are illustrated in FIG. 13 in curves 20 (Example 20), 21 (Example 21), and 22 (Example 22). The indicated C1 weight percents of the various dilutions are approximately the same as the volume percents. It is seen that the detection limit of conventional powder diffraction methods for bulk dispersions is on the order of 1% (w/w) or less. These data illustrate how a calibration curve could be constructed to ascertain the weight fraction of crystalline material in a bulk dispersion. Independent measurement, by HPLC for example, of the total amount of compound of interest in a dispersion then provides means for directly measuring the compound crystalline mass fraction of a compound in a bulk dispersion.

Examples 23–25

Figure 14:
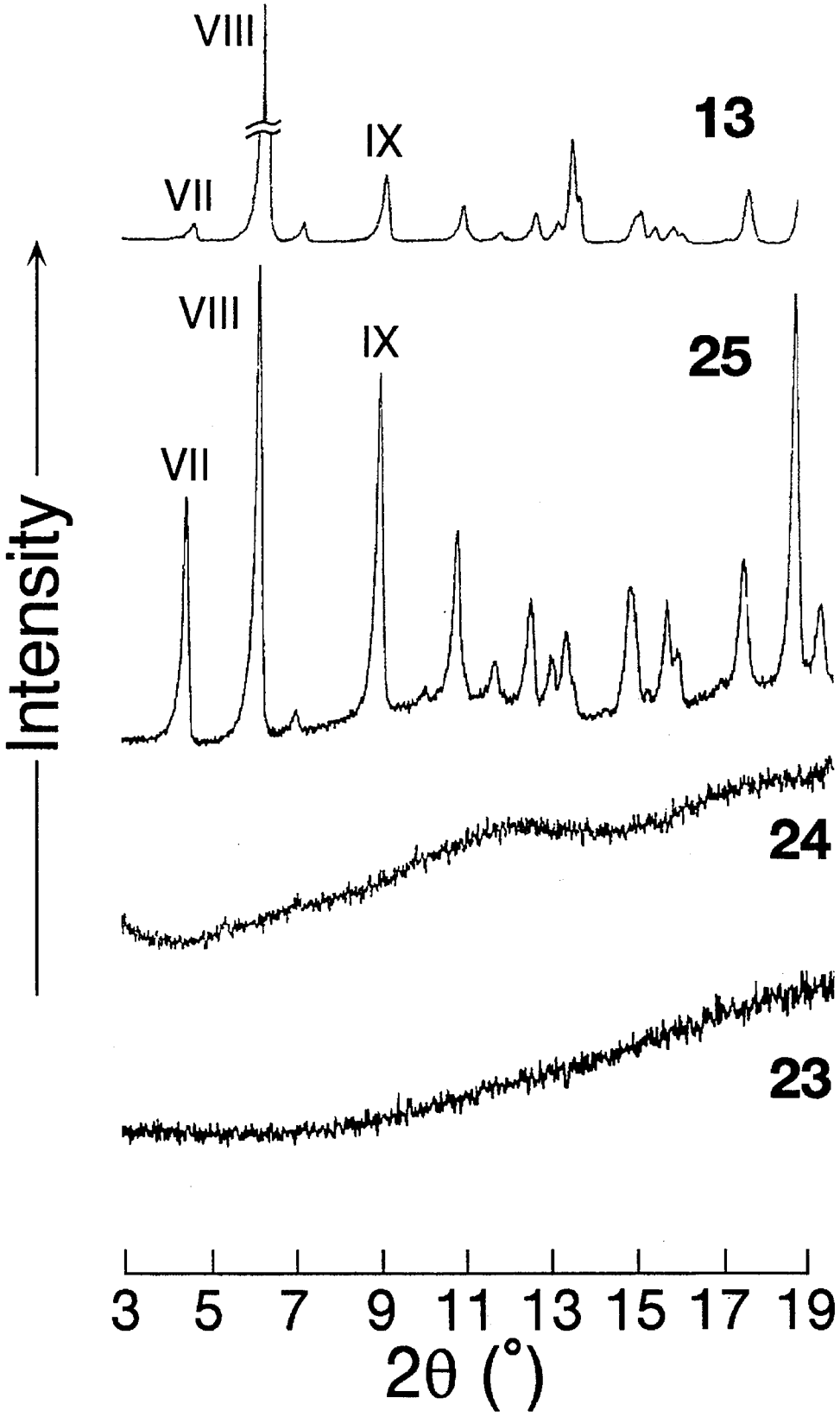
FIG. 14 Nanocrystallization of coupler C3 by mechanical annealing.

Mechanical annealing of bulk liquid dispersion is illustrated here with coupler C3. The same C3/S2 dispersion described above and used in preparing Example 11 was used here. A sample of this dispersion (Example 23) was examined by x-ray diffraction, and the resulting scattering data are illustrated in FIG. 14 as curve 23. No reflections are evident, indicating this starting dispersion is nanoamorphous. Furthermore, another sample of this dispersion was treated with a proteolytic enzyme, as described above for Example 11, mildly centrifuged, and the corresponding scattering data from analysis by x-ray diffraction are illustrated in FIG. 14 as curve 24. This concentrated sample (Example 24) exhibits no reflections, and is clearly nanoamorphous. Another sample of this dispersion (Example 23) was subjected to bulk centrifugation under more activating conditions, at 50° C. and 40000–50000 rpm for 16 h. The concentrated disperse phase (Example 25) was then examined by x-ray diffraction, and the corresponding data are illustrated in FIG. 14 as curve 25. Many prominent diffraction peaks are evident, indicating transformation to a nanocrystalline dispersion. A control sample of powdered coupler C3, illustrated as curve 13, shows the coincidence in the reflections labeled VII, VIII, and IX, as well as the coincidence for numerous other reflections. These data show that mechanical annealing in a centrifugal field induces nanocrystallization.

Example 26

A photographic element (Example 26) of the process of the present invention was formed using the invention nanocrystalline C1:S15 dispersion of Example 18. A two-layer light sensitive element was formed upon a transparent film base. The light sensitive layer contained dye forming coupler C1 from the C1:S15 dispersion of Example 18 at a coverage of $1.72\times10^{-7}$ mol/m$^2$ (816 mg/m$^2$), silver bromoiodide emulsion at a coverage of $1.93\times10^{-2}$ mol/m$^2$ (2.07 g/m$^2$) as silver, and gelatin at a coverage of 2.23 g/m$^2$. A protective overcoat consisting of gelatin at 881 mg/m$^2$ was coated over the light sensitive silver halide layer, and the gelatin in both layers was hardened with a crosslinking agent.

Example 27

An image was formed (Example 27) using the light-sensitive element of Example 26. A strip of the coating from Example 26 was exposed for 3 s with a tungsten source at a lamp temperature of 3000° K through a 0–6 density step tablet. This exposed strip was then developed for about 3 min 15 s in a C41 developing bath at about pH 10, bleached for about 4 min in an iron salt bleaching bath at a pH of about 5, washed, fixed in a thiosulfate fixing bath at a pH of about 6.5, washed,, and dried. The resulting cyan dye image was read on a densitometer, and a $D_{max}$–$D_{min}$ image of about 2.5 optical density units was obtained.

The invention has been described in detail with particular reference to preferred embodiments thereof, but it will be understood that variations and modifications can be effected within the spirit and scope of the invention.

What is claimed is:

1. A process for forming a nanocrystalline dispersion of a photographically useful compound in a continuous phase comprising the steps of:

providing a nanoamorphous dispersion of said photographically useful compound in said continuous phase, and annealing said nanoamorphous dispersion to transform the physical state of said chemical compound therein to a crystalline physical state and to thereby obtain a nanocrystalline dispersion.

2. A process as in claim 1, wherein the number average diameter of the chemical compound particulates transformed to said crystalline physical state is in the range of 10 to 500 nm.

3. A process as in claim 1, wherein the number average diameter of the chemical compound particulates transformed to said crystalline physical state is in the range of 10 to 200 nm.

4. A process as in claim 1, wherein said chemical compound is a photographic coupler.

5. A process as in claim 1, wherein said chemical compound is a photographically useful filter dye.

6. A process as in claim 1, wherein said chemical compound is a photographically useful oxidized developer scavenger.

7. A process as in claim 1, wherein said chemical compound is a photographically useful developing agent, reducing agent, electron transfer agent, or precursor thereof.

8. A process as in claim 1, wherein said nanoamorphous dispersion is prepared by solvent shifting.

9. A process as in claim 1, wherein said nanoamorphous dispersion is prepared by pH shifting.

10. A process as in claim 1, wherein said nanoamorphous dispersion is prepared by colloid milling, homogenization, high speed stirring, or sonication.

11. A process as in claim 1, wherein said nanoamorphous dispersion is prepared by microemulsification.

12. A process as in claim 1, wherein said nanoamorphous dispersion comprises a water immiscible organic solvent.

13. A process as in claim 1, wherein said nanoamorphous dispersion comprises a water immiscible organic solvent that has a low vapor pressure.

14. A process as in claim 1, wherein the compound crystalline mass fraction of said compound in said nanocrystalline dispersion is in the range of 10–97%.

15. A process as in claim 14, wherein the compound crystalline mass fraction of said compound in said nanocrystalline dispersion is in the range of 40–97%.

16. A process as in claim 15, wherein the compound crystalline mass fraction of said compound in said nanocrystalline dispersion is in the range of 80–97%.

17. A process as in claim 1, wherein the compound crystalline mass fraction of said compound n said nanocrystalline dispersion is in the range of 95–100%.

18. A process as in claim 1, wherein said annealing step comprises thermal annealing.

19. A process as in claim 18, wherein said thermal annealing comprises annealing at a temperature above the glass transition temperature of said chemical compound.

20. A process as in claim 18, which further comprises the step of coating said nanoamorphous dispersion in a thin layer prior to said annealing step, wherein said thin layer comprises no more than 25 $g/m^2$ of coated mass, exclusive of any coating solvent subsequently removed upon drying said thin layer.

21. A process as in claim 1, wherein said annealing step comprises chemical annealing.

22. A process as in claim 21, wherein said chemical annealing comprises removal of a slightly water-miscible organic solvent by washing means.

23. A process as in claim 21, wherein said chemical annealing comprises removal of a high vapor pressure organic solvent by evaporation means.

24. A process as in claim 21, wherein said chemical annealing comprises annealing at a temperature above the glass transition temperature of said chemical compound.

25. A process as in claim 1, wherein said annealing step comprises mechanical annealing.

26. A process as in claim 1, wherein said providing a nanoamorphous dispersion step excludes emulsification of an oil phase of said compound wherein said oil phase contains no water immiscible solvent.

* * * * *